US011831119B2

(12) United States Patent
Miyata et al.

(10) Patent No.: US 11,831,119 B2
(45) Date of Patent: Nov. 28, 2023

(54) SENSOR AND SENSOR MANUFACTURING METHOD

(71) Applicant: OMRON Corporation, Kyoto (JP)

(72) Inventors: Tsuyoshi Miyata, Ayabe (JP); Hiroyuki Mizusaki, Kyoto (JP); Yasuyoshi Sawada, Ayabe (JP); Yoshiki Tani, Ayabe (JP)

(73) Assignee: OMRON Corporation, Kyoto (JP)

( * ) Notice: Subject to any disclaimer, the term of this patent is extended or adjusted under 35 U.S.C. 154(b) by 311 days.

(21) Appl. No.: 17/287,114

(22) PCT Filed: Oct. 24, 2019

(86) PCT No.: PCT/JP2019/041592
§ 371 (c)(1),
(2) Date: Apr. 21, 2021

(87) PCT Pub. No.: WO2020/110526
PCT Pub. Date: Jun. 4, 2020

(65) Prior Publication Data

US 2021/0359430 A1 Nov. 18, 2021

(30) Foreign Application Priority Data

Nov. 30, 2018 (JP) ..... 2018-225792

(51) Int. Cl.
*H01R 4/24* (2018.01)
*H01R 4/2454* (2018.01)
(Continued)

(52) U.S. Cl.
CPC ..... *H01R 4/2454* (2013.01); *H01R 4/2406* (2018.01); *H01R 12/53* (2013.01)

(58) Field of Classification Search
CPC .. H01R 4/2462; H01R 4/2433; H01R 4/2454; H01R 4/2425; H01R 4/2466; H01R 4/2445; H01R 4/245; H01R 43/01
See application file for complete search history.

(56) References Cited

U.S. PATENT DOCUMENTS 3,854,114 A * 12/1974 Kloth ..... H01R 4/2462 439/398
3,937,549 A * 2/1976 Hughes ..... H01R 4/2462 439/401
(Continued)

FOREIGN PATENT DOCUMENTS

CN 105122554 12/2015
FR 2852744 9/2004
(Continued)

OTHER PUBLICATIONS

"International Search Report (Form PCT/ISA/210) of PCT/JP2019/041592," dated Dec. 10, 2019, with English translation thereof, pp. 1-4.
(Continued)

*Primary Examiner* — Ross N Gushi
(74) *Attorney, Agent, or Firm* — JCIPRNET

(57) ABSTRACT

Provided is a sensor which makes it easy to mount a cable to a circuit board. This sensor 1 is provided with: a circuit board 2; a connector 10 which is composed of a metal material and which is fixed to the circuit board 2; and a cable 3 which is connected to the circuit board 2 via the connector 10. The connector 10 has: a bottom part 11 that is connected to the circuit board 2; and a pair of pinching elements 12L, 12R that are raised upright from said bottom part 11. The cable 3 is held in a space S between the pair of pinching elements 12L, 12R.

13 Claims, 25 Drawing Sheets

(51) Int. Cl.
*H01R 4/2406* (2018.01)
*H01R 12/53* (2011.01)

(56) References Cited

U.S. PATENT DOCUMENTS

| | | | | |
|---|---|---|---|---|
| 4,350,404 | A * | 9/1982 | Clark | H01R 4/2462 439/399 |
| 4,370,009 | A * | 1/1983 | Dola | H01R 4/2425 439/177 |
| 6,722,007 | B2 | 4/2004 | Lin | |
| 9,543,665 | B2 * | 1/2017 | Sabo | H01R 4/2462 |
| 9,705,209 | B2 * | 7/2017 | Sabo | H01R 4/2454 |
| 2015/0038003 | A1 | 2/2015 | Sabo | |
| 2016/0072200 | A1 | 3/2016 | Sabo | |
| 2018/0048082 | A1 | 2/2018 | Sabo | |

FOREIGN PATENT DOCUMENTS

| | | |
|---|---|---|
| JP | S5322085 | 2/1978 |
| JP | S5753074 | 3/1982 |
| JP | H08329995 | 12/1996 |
| JP | 2011029125 | 2/2011 |
| JP | 2018152266 | 9/2018 |
| KR | 101905678 | 10/2018 |

OTHER PUBLICATIONS

"Written Opinion of the International Searching Authority (Form PCT/ISA/237) of PCT/JP2019/041592," dated Dec. 10, 2019, with English translation thereof, pp. 1-14.

"Office Action of Korea Counterpart Application", dated Feb. 10, 2023, with English translation thereof, p. 1-p. 19.

"Office Action of China Counterpart Application" with English translation thereof, dated Dec. 22, 2021, p. 1-p. 17.

"Search Report of Europe Counterpart Application", dated Jul. 1, 2022, p. 1-p. 8.

* cited by examiner

SENSOR AND SENSOR MANUFACTURING METHOD

CROSS-REFERENCE TO RELATED APPLICATION

This application is a 371 application of the International PCT application serial no. PCT/JP2019/041592, filed on Oct. 24, 2019, which claims the priority benefits of Japan Patent Application No. 2018-225792, filed on Nov. 30, 2018. The entirety of each of the above-mentioned patent applications is hereby incorporated by reference herein and made a part of this specification.

TECHNICAL FIELD

The invention relates to a sensor.

BACKGROUND ART

A strand that transmits signals of electronic components such as sensor elements mounted on a circuit board is connected to the circuit board of the sensor (for example, see Patent Literature 1).

CITATION LIST

Patent Literature

[Patent Literature 1]
Japanese Patent Laid-Open No. 2018-152266

SUMMARY OF INVENTION

Technical Problem

As the sensor becomes smaller, the number of components mounted on the circuit board increases, and thus the interval between adjacent strands in the mounting space of the circuit board on which the strands are mounted is narrowed. However, since the strands are mounted on the circuit board by soldering, if the interval between the strands is too narrow, solder may flow to the adjacent strands and cause a short-circuit or a high-temperature soldering iron may contact with the adjacent strands and cause damage. Further, the quality of soldering and the working time are easily affected by an operator and the appearance, connection reliability, and the like may vary.

As the mounting space for strands increases, it becomes more difficult to solder a cable to the circuit board. Here, an objective of the invention is to provide a sensor capable of easily mounting a cable on a circuit board.

Solution to Problem

A sensor according to an aspect of the present disclosure includes: a circuit board; a connector which is composed of a metal material and which is fixed to the circuit board; and a cable which is connected to the circuit board via the connector. The connector includes a bottom part connected to the circuit board and a pair of pinching elements raised upright from the bottom part. The cable is pinched in a space sandwiched between the pair of pinching elements.

According to this aspect, since soldering can be omitted in the step of mounting the cable on the circuit board, the cable can be easily mounted on the circuit board. In addition, the sensor can be miniaturized by mounting the wires at high density.

Since soldering which tends to vary depending on the operator can be omitted, it is possible to prevent the occurrence of defective products, improve quality, and make them uniform. Since it is possible to assemble even by an unskilled person and shorten the work time, it is possible to decrease a cost.

In the above-described aspect, a plurality of pinching parts including the pair of pinching elements may be provided in an extension direction of the cable.

According to this aspect, the cable is pinched at a plurality of positions. Accordingly, even when the cable comes off in one of the pinching parts, the cable can be fixed in the other pinching parts. The strength when the cable is pulled is improved and the cable can be fixed more reliably.

In the above-described aspect, the pair of pinching elements may be formed mirror-symmetrically when viewed from an intermediate position of the pair of pinching elements.

According to this aspect, even a minute connector does not undergo overly complicated press working due to the simple shape with symmetry. The manufacturability in the step of forming the connector is excellent.

In the above-described aspect, the connector may be formed by a bent metal foil. The metal foil includes a first surface, a second surface on the side opposite to the first surface, and an end surface connecting the first surface and the second surface. The pair of pinching elements may pinch the cable by using the end surface.

If the cable is pinched by the first surface or the second surface of the bent metal foil, the metal foil is likely to be bent when an external force is applied. Accordingly, there is concern that the cable cannot be reliably fixed. According to this aspect, since the cable is pinched by the end surface of the metal foil which is not likely to be deformed, the cable can be reliably fixed.

In the above-described aspect, the connector may be formed by the metal foil bent a plurality of times so that all creases are orthogonal to the extension direction of the cable.

According to this aspect, since all creases are parallel to each other, even a minute connector does not undergo overly complicated press working. The manufacturability in the step of forming the connector is excellent.

In the above-described aspect, the second surface in the bottom part may be connected to the circuit board. The pinching element may include a pair of first pinching elements pinching the cable and a pair of second pinching elements disposed along the first pinching elements. The second surface of the first pinching element may face the second surface of the second pinching element.

According to this aspect, since the cable is pinched at a plurality of positions by the first pinching element and the second pinching element, the strength when the cable is pulled is improved and the cable can be fixed more reliably. The first pinching element and the second pinching element can be configured to pinch other members of the cable. For example, the first pinching element may be configured to pinch the core wire of the cable and the second pinching element may be configured to pinch the inner covering of the cable.

In the above-described aspect, the cable may include a plurality of strands and an outer covering bundling the plurality of strands and each of the strands may include a core wire composed of a plurality of conductive wires and an inner covering the core wire. The pair of first pinching elements may pinch the core wire.

According to this aspect, the cable can be mounted on the circuit board just by pressing the cable toward the bottom part. The core wire may be covered with the inner covering or may be exposed from the inner covering.

In the above-described aspect, the first pinching element may include a receiving part provided at a tip of the first pinching element and provided so that an interval of the pair of first pinching elements becomes narrow as it goes toward the bottom part.

According to this aspect, the cable can be easily aligned by being guided to the receiving part.

In the above-described aspect, the end surfaces of the pair of pinching elements in the receiving part may be formed in a wedge shape.

According to this aspect, the connector and the core wire can be electrically connected to each other by cutting the inner covering with the pressure-contact blade formed on the end surface of the receiving part.

In the above-described aspect, the cable may include a plurality of strands and an outer covering bundling the plurality of strands and each of the strands may include a core wire composed of a plurality of conductive wires and an inner covering the core wire. All of the pair of first pinching elements and the pair of second pinching elements may pinch the inner covering. At least one of the bottom part, the first pinching element, and the second pinching element may include a pressure-contact blade that penetrates the inner covering and is conductive to the core wire.

According to this aspect, since it is possible to omit the step of exposing the core wire by cutting the inner covering, the manufacturability in the step of mounting the cable on the circuit board is excellent. Since the pressure-contact blade bites into the cable, the cable does not easily come off.

In the above-described aspect, the pinching element may include a returning part provided so that an interval of the pair of pinching elements becomes narrow as it goes away from the bottom part. The returning part may be formed to be narrower than a diameter of the inner covering in a portion in which the interval of the pair of pinching elements is the narrowest.

According to this aspect, since the returning part is provided, it is possible to prevent the cable from coming off from the connector.

In the above-described aspect, each of the first pinching element and the second pinching element may include the pressure-contact blade. A plurality of the pressure-contact blades may penetrate the inner covering while the connector is tightened so that the interval of the pair of first pinching elements becomes narrow and the interval of the pair of second pinching elements becomes narrow.

According to this aspect, since it is possible to omit the step of exposing the core wire by cutting the inner covering, the manufacturability in the step of mounting the cable on the circuit board is excellent. Since the pressure-contact blade is conductive to the core wire at a plurality of positions, the connection reliability of finished products is improved. Since the connector is tightened and irreversibly deformed and the pressure-contact blade bites into the cable, the cable does not easily come off.

In the above-described aspect, the cable may not be fixed while the connector is not tightened and the cable may be pinched by the pair of pinching elements while the connector is tightened so that the interval of the pair of pinching elements becomes narrow.

According to this aspect, since the cable is not fixed until the cable is tightened, the distance of the pair of pinching elements can be increased. The cable can be easily placed between the pair of pinching elements. When the connector is tightened, the connector is irreversibly deformed and the cable does not easily come off.

A sensor manufacturing method according to an aspect of the present disclosure includes: a first step of forming a connector including a bottom part and a pair of pinching elements raised upright from the bottom part by a metal material; a second step of connecting the connector to a circuit board; and a third step of pressing a cable toward the bottom part and pinching the cable in a space sandwiched between the pair of pinching elements.

According to this aspect, since soldering can be omitted in the step of mounting the cable on the circuit board, the cable can be easily mounted on the circuit board.

In the above-described aspect, the connector may be connected to the circuit board by fixing through any of soldering, welding, and adhering with a conductive paste.

According to this aspect, the pre-manufactured connector can be easily mounted on the circuit board.

The cable may include a plurality of strands and an outer covering bundling the plurality of strands and each of the strands may include a core wire composed of a plurality of conductive wires and an inner covering the core wire. The connector may further include a pressure-contact blade provided in the bottom part. In the third step, the pressure-contact blade may penetrate the inner covering to be conductive to the core wire.

According to this aspect, since it is possible to omit the step of exposing the core wire by cutting the inner covering, the manufacturability in the step of mounting the cable on the circuit board is excellent. Since the pressure-contact blade bites into the cable, the cable does not easily come off.

In the above-described aspect, the connector may further include a pressure-contact blade provided in the pinching element. The sensor manufacturing method may further include, after the third step, a fourth step of tightening the connector so that an interval of the pair of pinching elements becomes narrow. In the fourth step, the pressure-contact blade may penetrate the inner covering to be conductive to the core wire.

According to this aspect, since it is possible to omit the step of exposing the core wire by cutting the inner covering, the manufacturability in the step of mounting the cable on the circuit board is excellent. Since the connector is tightened and irreversibly deformed and the pressure-contact blade bites into the cable, the cable does not easily come off.

In the above-described aspect, the sensor manufacturing method may further include a fifth step of covering the core wire with a solder layer. The sensor manufacturing method may further include, after the third step, a fourth step of tightening the connector so that the interval of the pair of pinching elements becomes narrow. In the fourth step, the pinching element may penetrate the solder layer to be conductive to the core wire.

According to this aspect, since the pinching element is directly conductive to the core wire, the connection reliability of finished products is improved. Since the connector is tightened and irreversibly deformed, the cable does not easily come off.

Advantageous Effects of Invention

According to the invention, it is possible to provide a sensor capable of easily mounting a cable on a circuit board.

DESCRIPTION OF EMBODIMENTS

Figure 1:
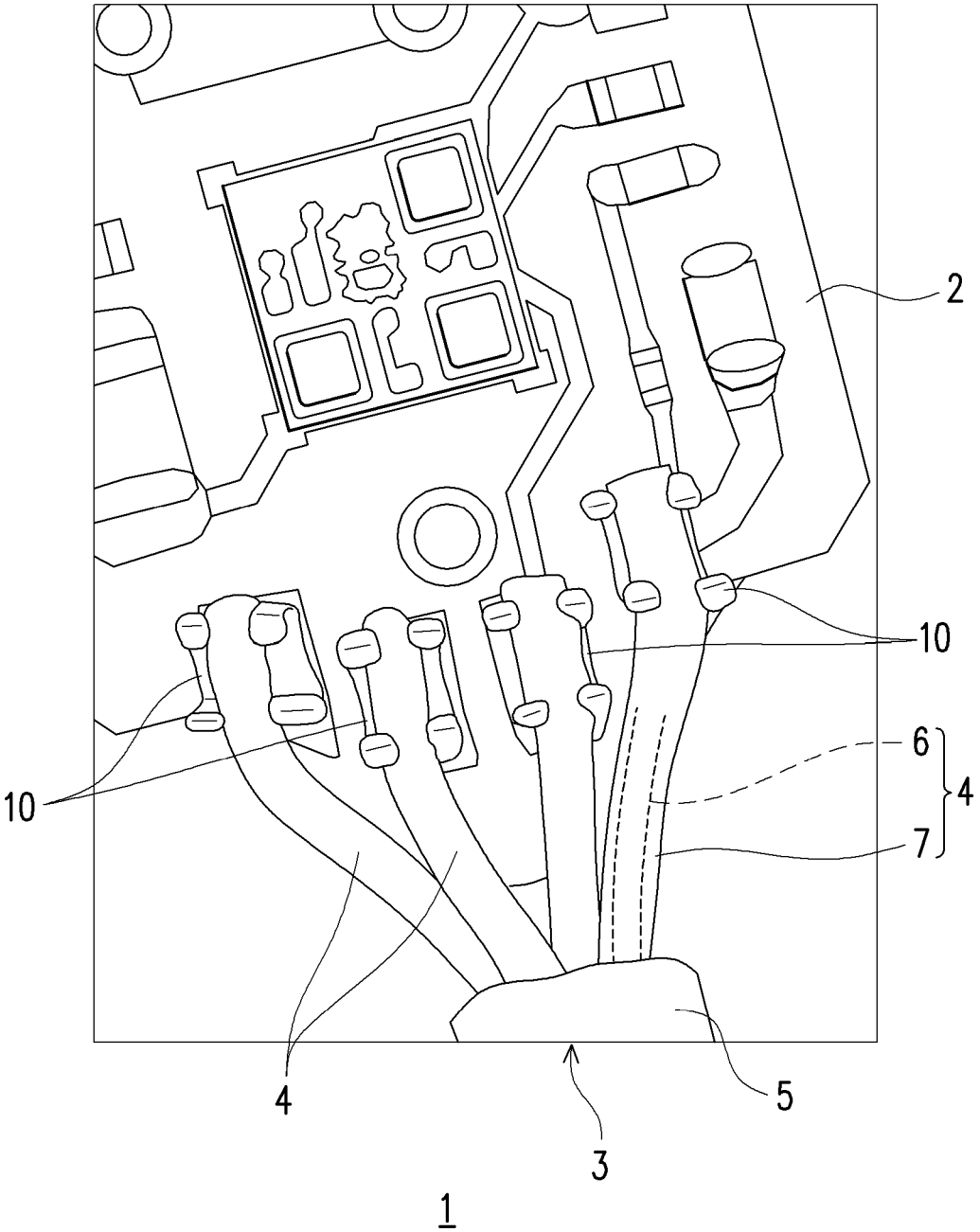
FIG. 1 is a diagram showing an internal structure of a sensor according to an embodiment of the invention.

Preferred embodiments of the invention will be described with reference to the accompanying drawings. In the drawings, those having the same reference numerals have the same or similar configurations. A sensor 1 of an embodiment of the invention includes a connector 10 which is composed of a conductive material such as a metal foil (see FIG. 1). The connector 10 includes a bottom part 11 and a pair of pinching elements 12L and 12R raised upright from the bottom part 11 (see FIGS. 2, 9, 13, and 16). Since it is only necessary to press a strand 4 into a space S between the pair of pinching elements 12L and 12R (see FIG. 6A), a cable 3 can be easily mounted on a circuit board 2 (see FIG. 7). A core wire 6 of the strand 4 may be covered with an inner covering 7 (see FIG. 6B) or may be exposed from the inner covering 7 (see FIG. 8). The connector 10 may be tightened in order to more strongly fix the strand 4 (see FIGS. 15B and 18). Hereinafter, each configuration will be described in detail with reference to FIGS. 1 to 21.

First, a configuration common to each embodiment will be described with reference to FIG. 1. FIG. 1 is a perspective view showing the sensor 1 of an embodiment of the invention. As shown in FIG. 1, the sensor 1 includes a circuit board 2 on which an electronic component such as a sensor element is mounted, a plurality of connectors 10 which are mounted on the circuit board 2, and a cable 3 which is connected to the circuit board 2 via the connector 10 and transmits a signal from a sensor element. The cable 3 includes the strand 4 which is electrically and mechanically connected to each connector 10 and an outer covering 5 which bundles the plurality of strands 4. The strand 4 includes the core wire 6 composed of a plurality of conductive wires and the inner covering 7 covering the core wire 6.

First Embodiment

Figure 2:
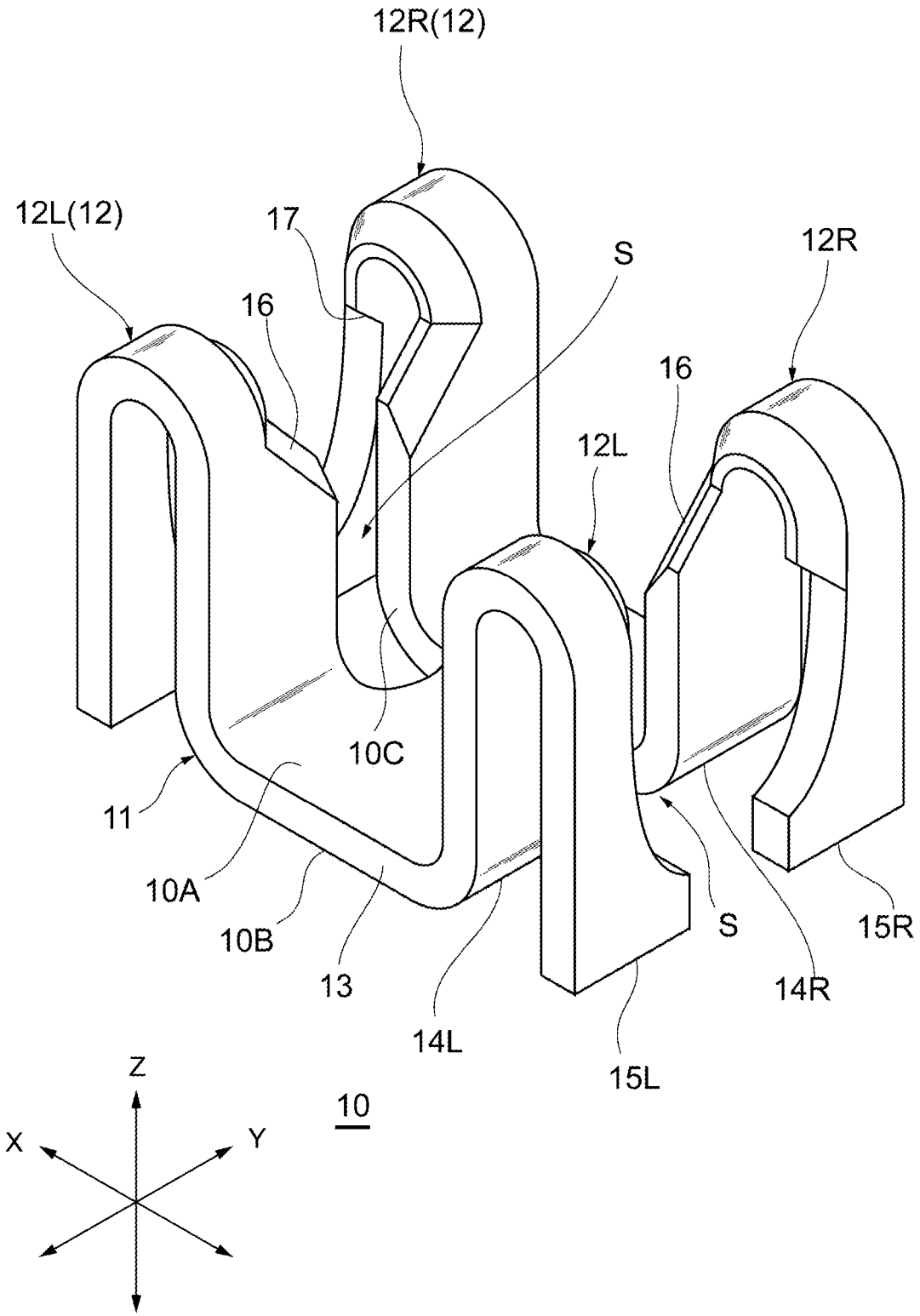
FIG. 2 is a perspective view showing a connector according to a first embodiment of the invention.

FIG. 2 is a perspective view showing the connector 10 according to a first embodiment of the invention. As shown in FIG. 2, the connector 10 includes the bottom part 11 which is fixed to the circuit board 2 and a pinching part 12 which pinches the strand 4. When the circuit board 2 is placed on a horizontal plane, the pinching part 12 of the connector 10 opens upward. The pinching part 12 includes the pair of pinching elements 12L and 12R raised upright from the bottom part 11 and can pinch the strand 4 of the cable 3 in the space S between the pair of pinching elements 12L and 12R. In the example shown in the drawings, the connector 10 includes two sets of pinching parts 12 arranged in the extension direction X of the strand 4 with the bottom part 11 interposed therebetween.

Figure 3:
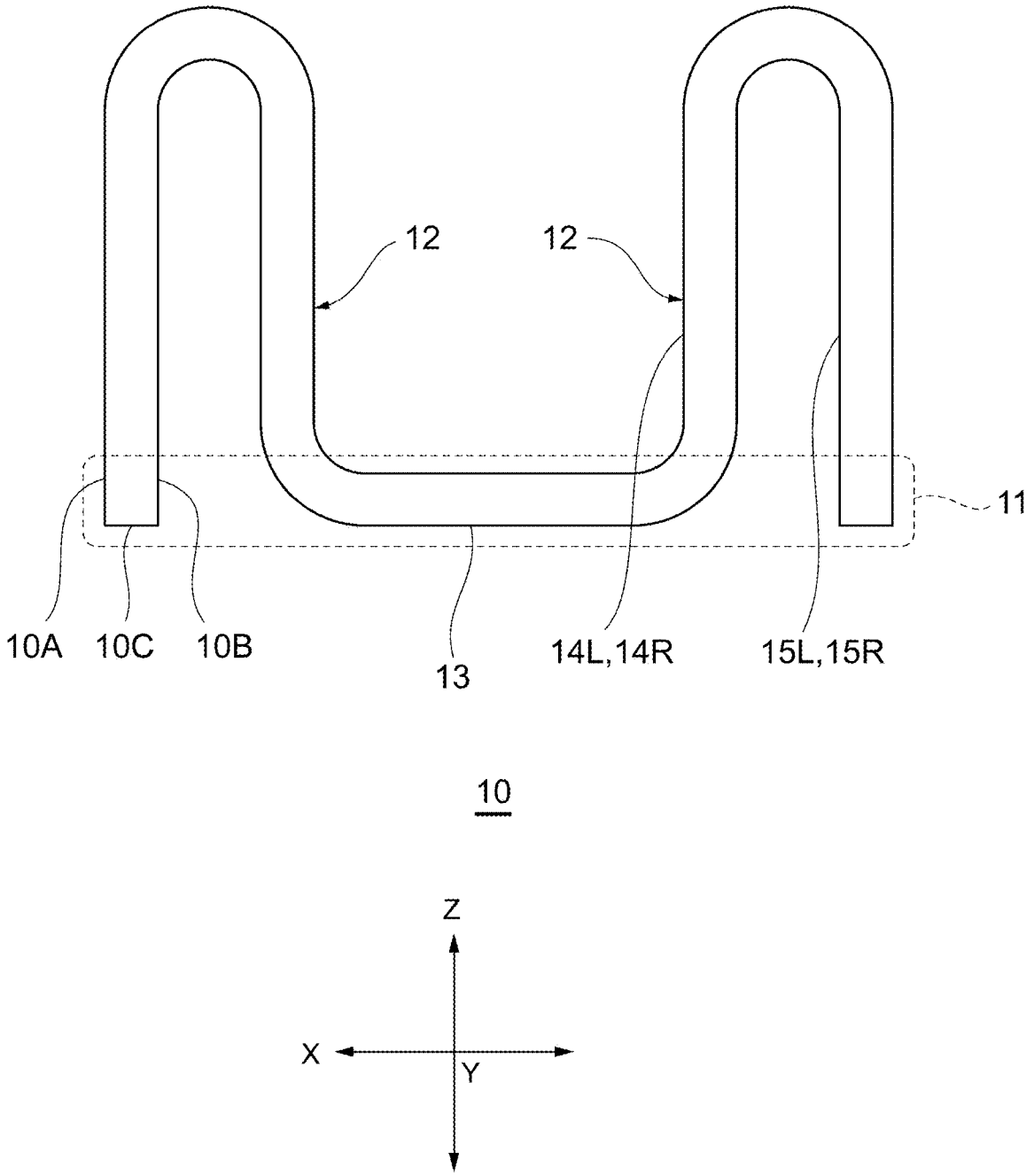
FIG. 3 is a side view of the connector shown in FIG. 2.

FIG. 3 is a side view of the connector 10 when viewed from a direction Y orthogonal to the thickness direction Z of the circuit board 2 and the extension direction X of the strand 4. As shown in FIG. 3, the connector 10 is formed by, for example, bending a single metal foil and the bottom part 11 and the pinching part 12 are integrally formed with each other. The metal foil constituting the connector 10 includes a first surface 10A, a second surface 10B which is on the side opposite to the first surface 10A, and an end surface 10C which connects the first and second surfaces 10A and 10B. Additionally, the connector 10 is not limited to the bent metal foil and may be formed by plating a block having the bottom part 11 and the pinching part 12 protruding from the bottom part 11 with a conductive material.

The pinching part 12 includes a pair of first pinching elements 14L and 14R and a pair of second pinching elements 15L and 15R. The first pinching elements 14L and 14R are continuous to a bottom plate 13 constituting most of the bottom part 11. In the bottom plate 13, the second surface 10B of the metal foil is electrically and mechanically connected to the circuit board 2 by fixing through any of soldering, welding, and adhering with a conductive paste.

The second pinching elements 15L and 15R are continuous to the first pinching elements 14L and 14R. The end parts on the side opposite to the first pinching elements 14L and 14R in the second pinching elements 15L and 15R constitute the rest of the bottom part 11. The end parts of the second pinching elements 15L and 15R constituting a part of the bottom part 11 are preferably fixed to the circuit board 2, but may not be essentially fixed to the circuit board 2. When the end part of the second pinching element 15L (15R) is fixed to the circuit board 2, the pinching element 12L (12R) becomes arched and is not easily deformed even when a force pressing the cable 3 into the connector 10 acts. The second surface 10B of the metal foils of the first pinching elements 14L and 14R faces the second surface 10B of the metal foils of the second pinching elements 15L and 15R.

Figure 4:
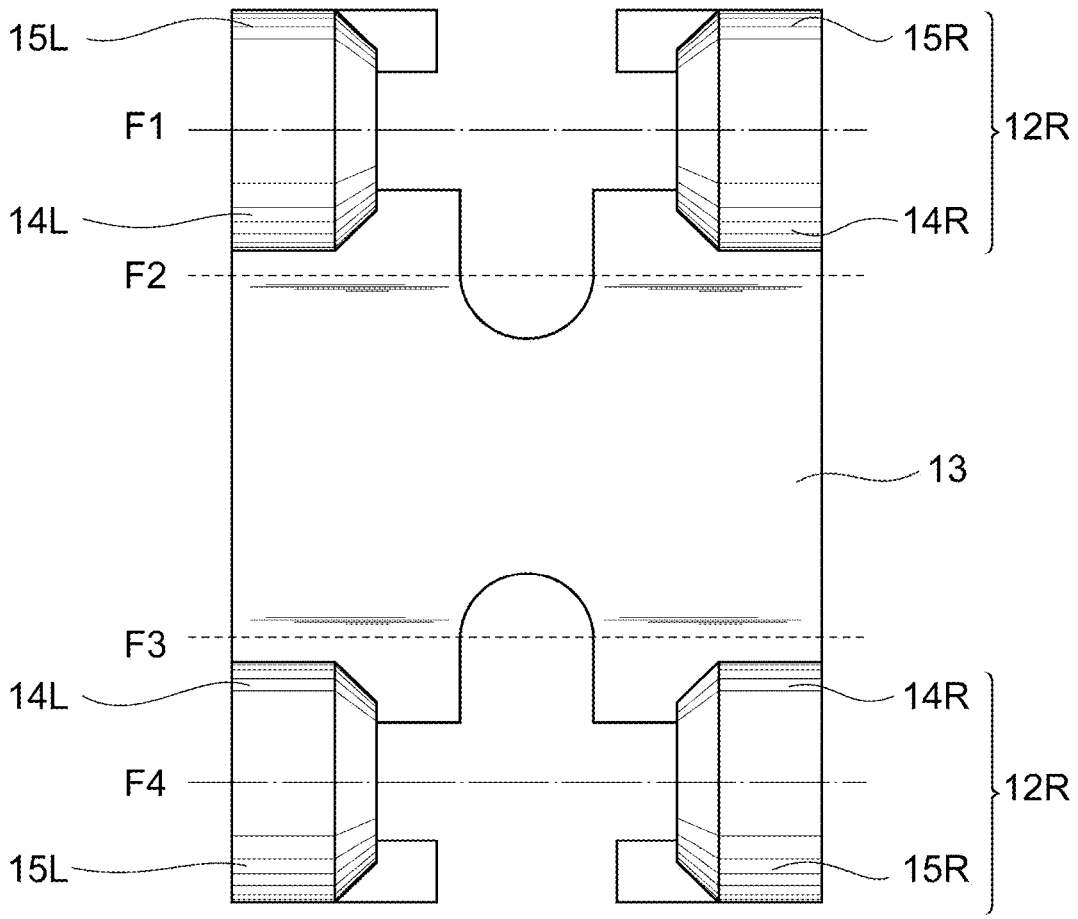
FIG. 4 is a plan view of the connector shown in FIG. 2.
Figure 4:
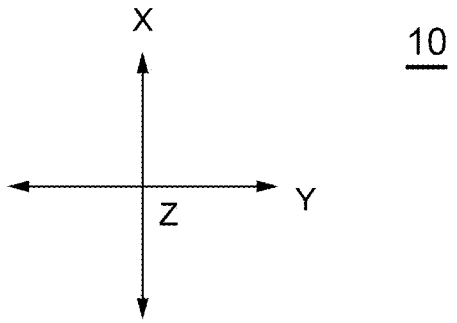

FIG. 4 is a plan view of the connector 10 when viewed from the thickness direction Z of the circuit board 2. As shown in FIG. 4, all of creases F1 and F4 between the bottom plate 13 and the first pinching elements 14L and 14R and creases F2 and F3 between the first pinching elements 14L and 14R and the second pinching elements 15L and 15R extend in the above-described direction Y. When the metal foil of the connector 10 is unfolded, the metal foil has a substantially rectangular shape and four sides extend in the extension direction X of the strand 4 and the crease direction Y of the metal foil.

Figure 5:
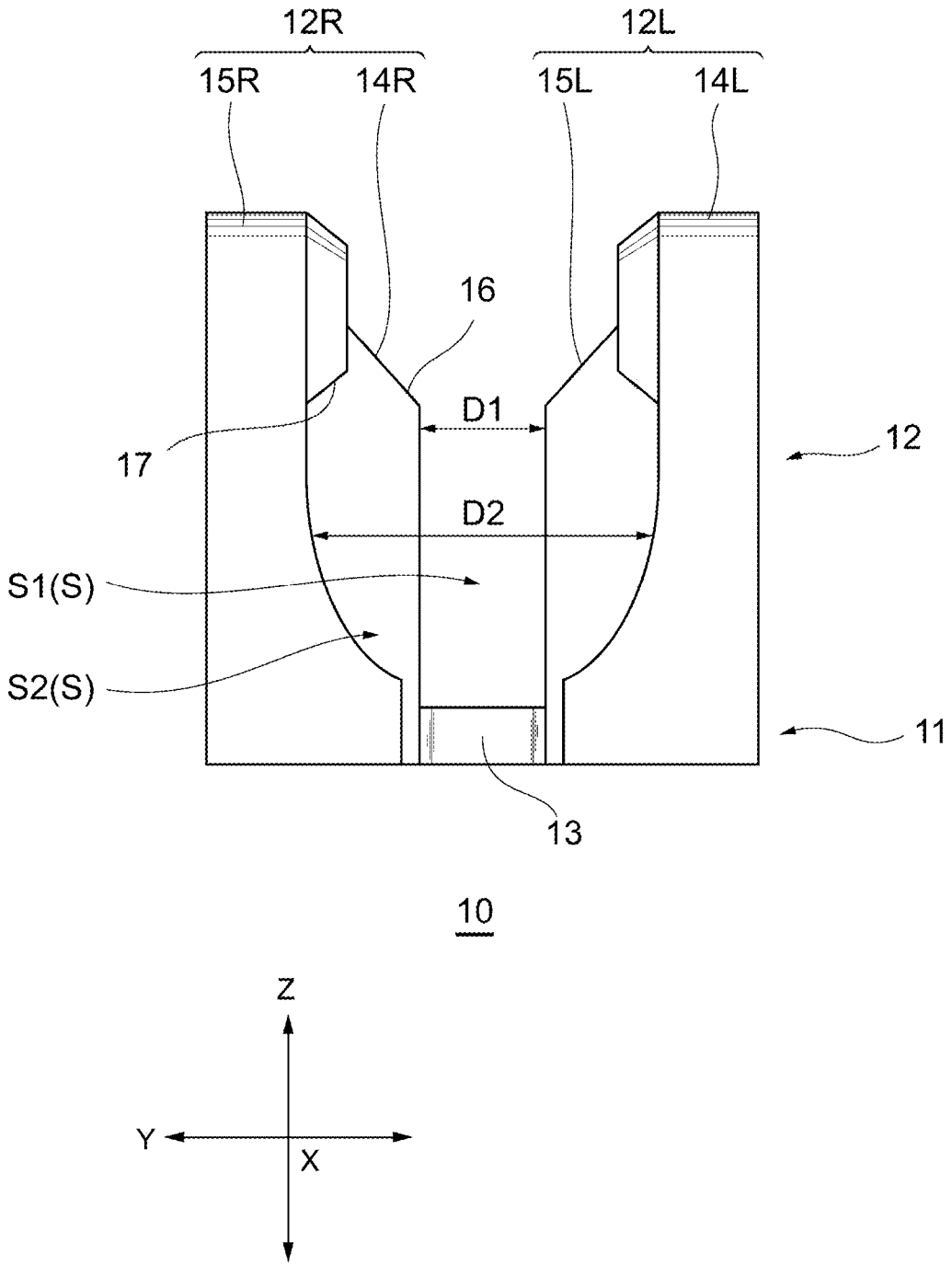
FIG. 5 is a rear view of the connector shown in FIG. 2.

FIG. 5 is a rear view of the connector 10 when viewed from the tip side of the strand 4 in the extension direction X. In the example shown in FIG. 5, the pair of first pinching elements 14L and 14R is formed mirror-symmetrically when viewed from the intermediate position of the pair of pinching elements 14L and 14R (for example, the center of the pinched strand 4). Similarly, the pair of second pinching elements 15L and 15R is formed mirror-symmetrically when viewed from the intermediate position of the second pinching elements 15L and 15R. As shown in FIG. 5, the pair of first pinching elements 14L and 14R faces each other with an interval D1 interposed therebetween. The first pinching elements 14L and 14R are provided with a receiving part 16 which is formed at the end parts on the side opposite to the bottom part 11, that is, the end parts on the side of the second pinching elements 15L and 15R, so that the interval D1 becomes narrow as it goes toward the bottom part 11. In the receiving part 16, the end surface 10C of the metal foil is formed in a wedge shape and functions as a pressure-contact blade for cutting the inner covering 7.

Similarly to the pair of first pinching elements 14L and 14R, the pair of second pinching elements 15L and 15R faces each other with an interval D2 interposed therebetween. The second pinching elements 15L and 15R are provided with a returning part 17 which is formed at the end parts on the side opposite to the bottom part 11, that is, the end parts on the side of the first pinching elements 14L and 14R, so that the interval D2 becomes narrow as it goes away from the bottom part 11. The returning part 17 is formed to be narrower than the diameter of the inner covering 7 for covering the core wire 6 in a part where the interval D2 is the narrowest.

In the example shown in the drawings, the end parts (hereinafter, referred to as the lower end parts) on the side of the bottom part 11 in the pair of second pinching elements 15L and 15R are not continuous and are independent of each other. Additionally, as in a third embodiment or a fourth embodiment to be described later, the lower end parts of the pair of second pinching elements 15L and 15R may be formed continuously. When the lower end parts of the pair of second pinching elements 15L and 15R are continuous, the second pinching elements 15L and 15R are not likely to be deformed and the strength of the connector 10 is improved. Since the contact area between the connector 10 and the circuit board 2 is wide, the joint strength between them is improved.

Meanwhile, when the lower end parts of the pair of second pinching elements 15L and 15R are not continuous, the pair of second pinching elements 15L and 15R can be widened like a spring. Accordingly, the strand 4 having a large thickness of the inner covering 7 can also be accommodated in a space S2 between those pinching elements. Further, since the circuit board 2 is exposed between the lower end parts of the pair of second pinching elements 15L and 15R, the height of the cable 3 can be suppressed by bringing the strand 4 closer to the circuit board 2.

In the example shown in the drawings, the lower end parts of the pair of second pinching elements 15L and 15R are formed so that the interval D2 becomes narrow as it goes toward the bottom part 11. In other words, it is formed so that the hem becomes wider as it goes toward the circuit board 2 so that the contact area is wide when fixed to the circuit board 2.

Figure 6A:
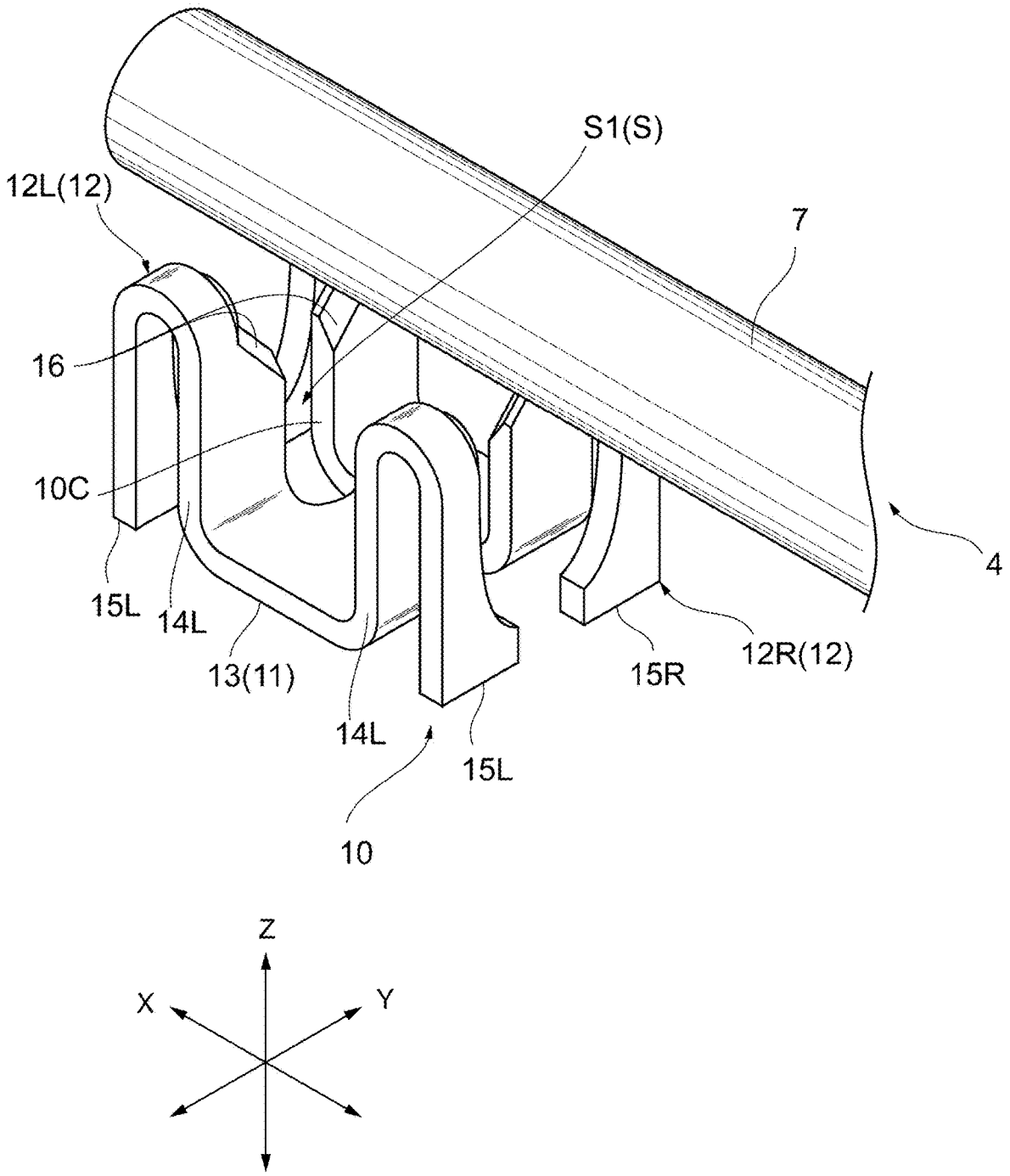
FIG. 6A is a perspective view showing a usage example of the connector according to the first embodiment of the invention.
Figure 6B:
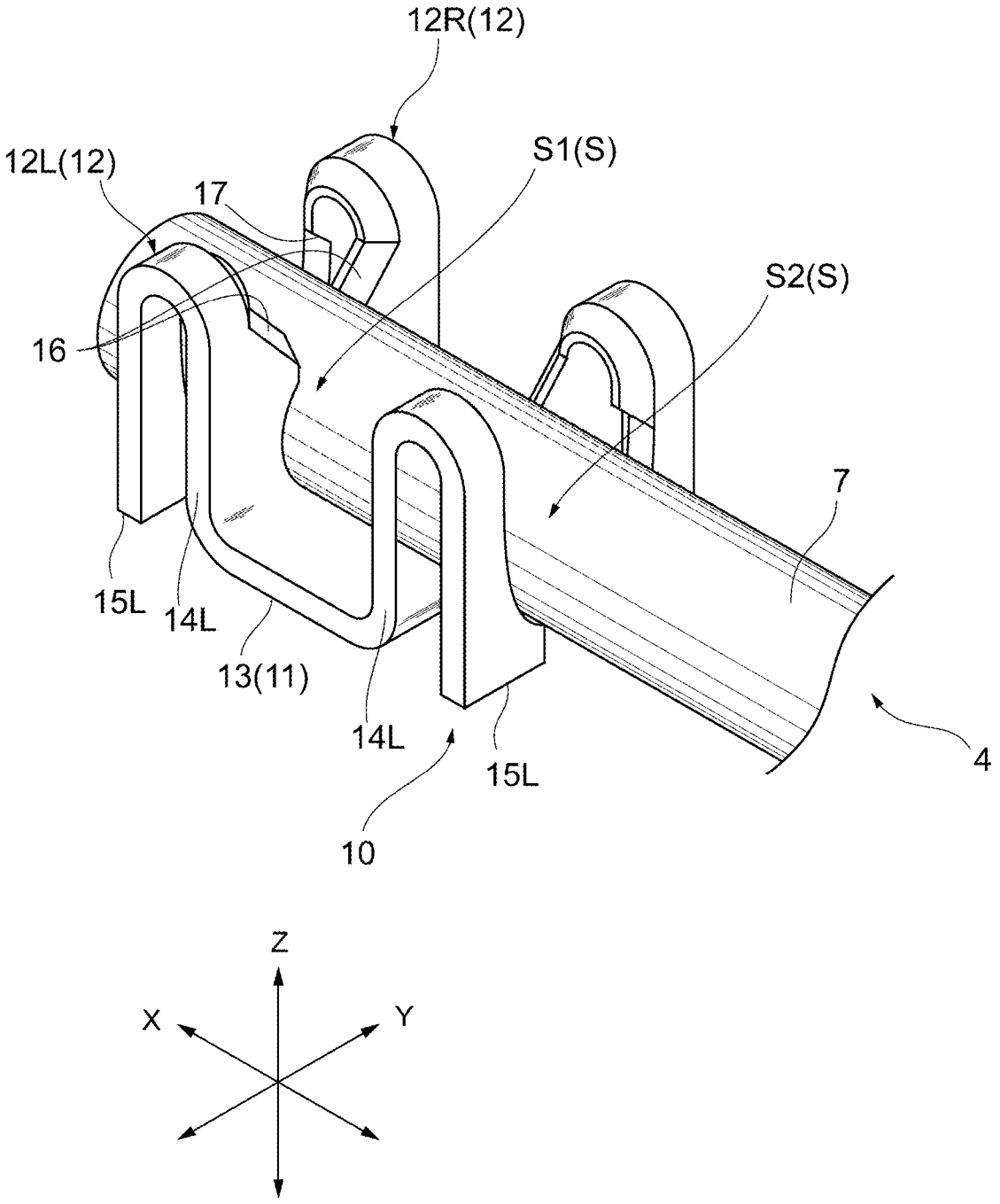
FIG. 6B is a perspective view showing a usage example of the connector according to the first embodiment of the invention after FIG. 6A.

FIGS. 6A and 6B are perspective views showing a usage example of the connector 10 according to the first embodiment of the invention. As shown in FIG. 6A, when the strand 4 is pressed from above the connector 10 toward the bottom part 11, the strand 4 is guided by the receiving part 16. As shown in FIG. 6B, when the strand 4 is further pressed, the inner covering 7 is cut by the end surface 10C of the receiving part 16 and the core wire 6 is pinched in the space S1 sandwiched by the pair of first pinching elements 14 constituting the pinching part 12. The space S1 is an example of the space S inside the pinching part 12. The connector 10 is composed of a conductive material such as a metal foil and at least a part (for example, the bottom plate 13) of the bottom part 11 is electrically and mechanically connected to the circuit board 2. Therefore, the strand 4 pinched by the pinching part 12 is electrically and mechanically connected to the circuit board 2 via the connector 10. That is, the strand 4 is mounted on the circuit board 2.

Figure 7:
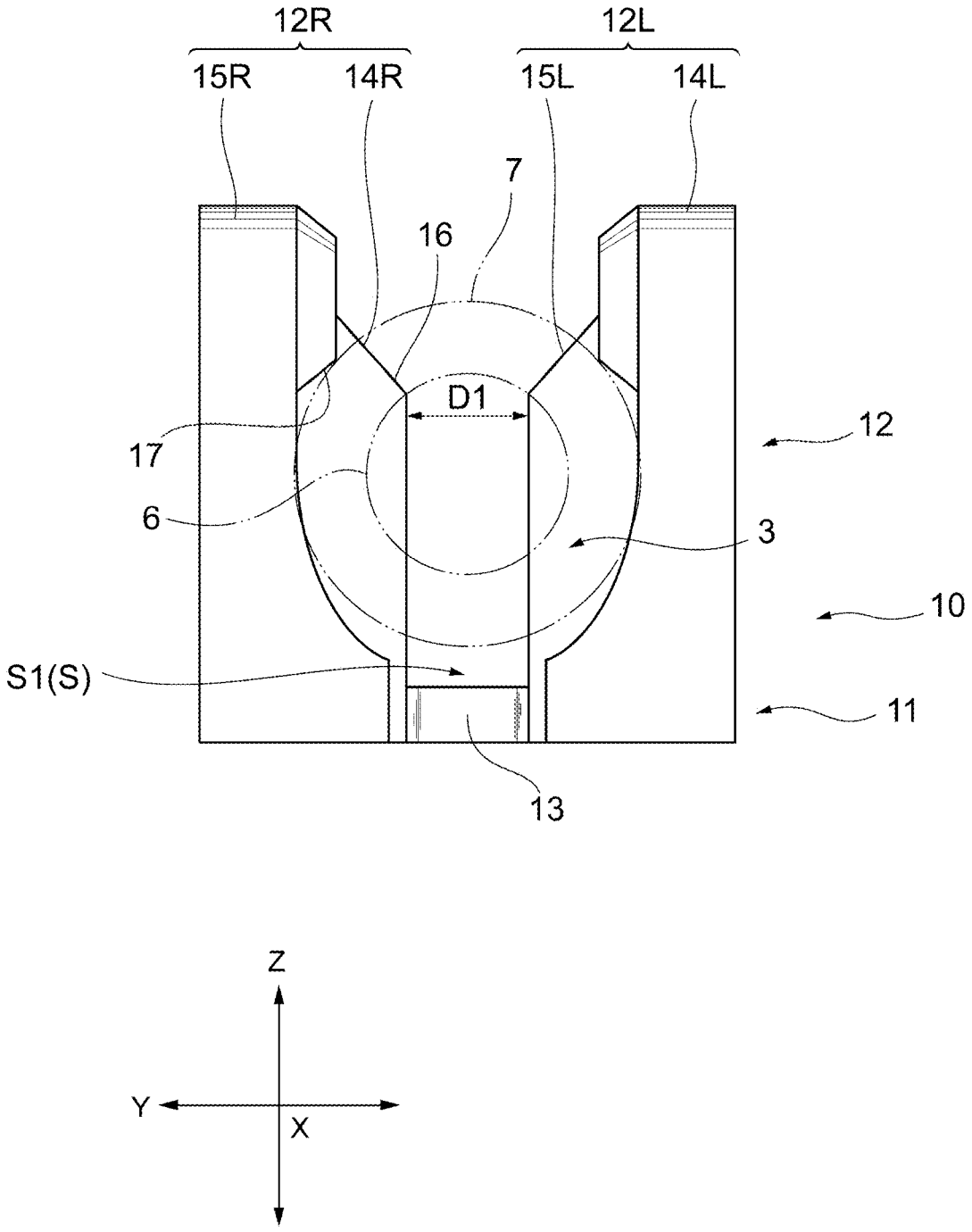
FIG. 7 is a rear view of a strand mounted on the connector as viewed from a tip side.

FIG. 7 is a rear view of the strand 4 mounted on the connector 10 when viewed from the tip side. As shown in FIG. 7, the interval D1 of the pair of first pinching elements 14L and 14R is formed to be narrower than the diameter of the core wire 6 in a part on the side of the bottom part 11 in relation to the receiving part 16. Therefore, the pair of first pinching elements 14L and 14R can bite into the core wire 6 to be conductive to the core wire 6 and to fix the core wire 6 to the circuit board 2. In the example shown in the drawings, the interval D1 is formed to be about 70% of the diameter of the core wire 6.

At least one of the intervals D1 and D2 of the first pinching elements 14L and 14R and the second pinching elements 15L and 15R is formed to be narrower than the diameter of the core wire 6 in a part on the side of the bottom part 11 in relation to the receiving part 16. Therefore, the connector 10 can fix the strand 4 by the pinching part 12 regardless of the presence of the inner covering 7.

Figure 8:
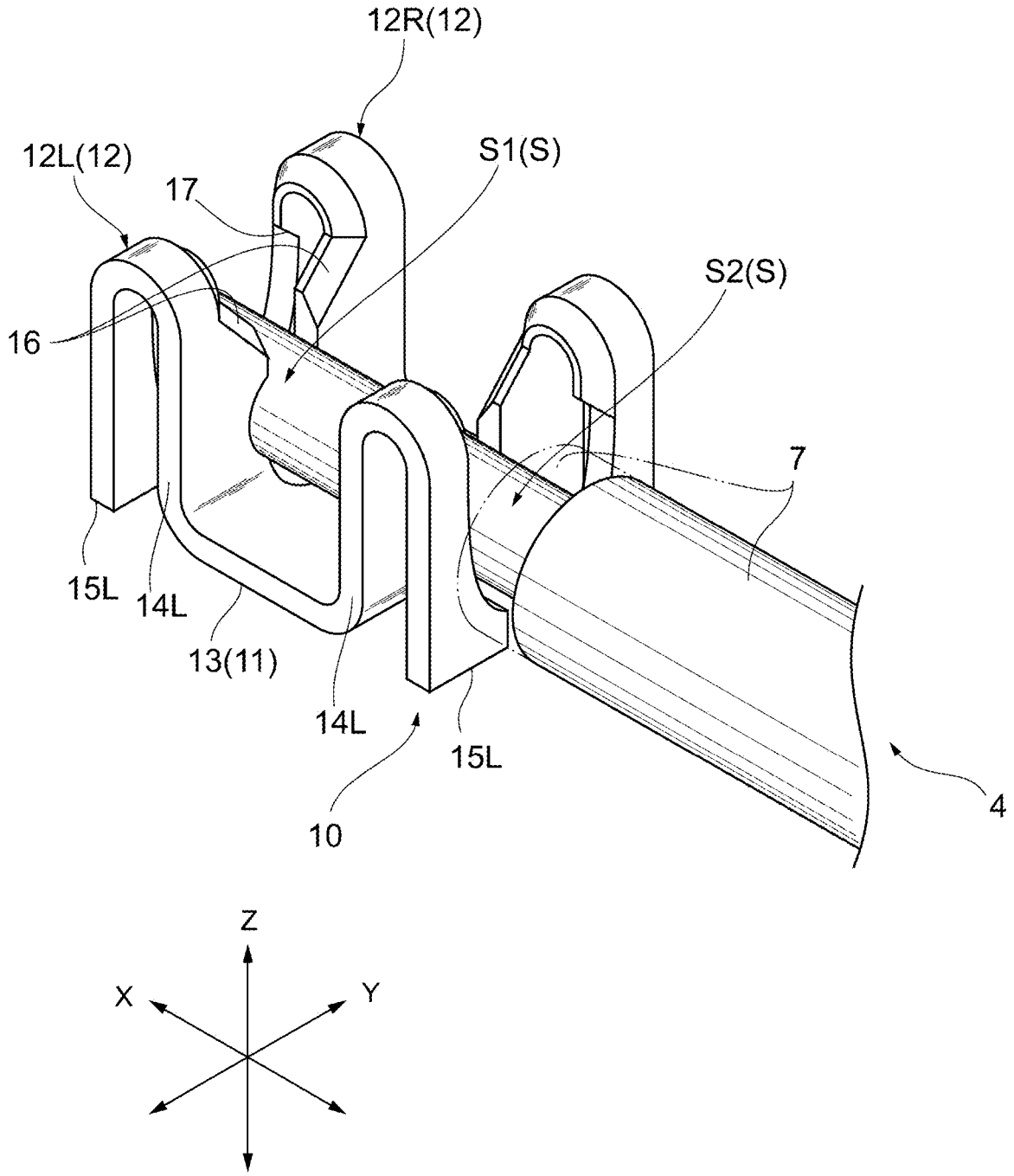
FIG. 8 is a perspective view showing a modified example of the connector shown in FIG. 6B.

FIG. 8 is a perspective view showing a usage example of the connector 10 according to a modified example of the first embodiment of the invention. As shown in FIG. 8, in the strand 4, the inner covering 7 may be cut so that the core wire 6 is exposed and the core wire 6 exposed from the inner covering 7 may be covered with a solder layer. In the example shown in the drawings, the pair of second pinching elements 15L and 15R faces the core wire 6 with a gap. Additionally, the strand 4 may be moved in the extension direction X so that the inner covering 7 is pinched in the space S2 sandwiched by the pair of second pinching elements 15L and 15R (indicated by a virtual line in FIG. 8).

Figure 20:
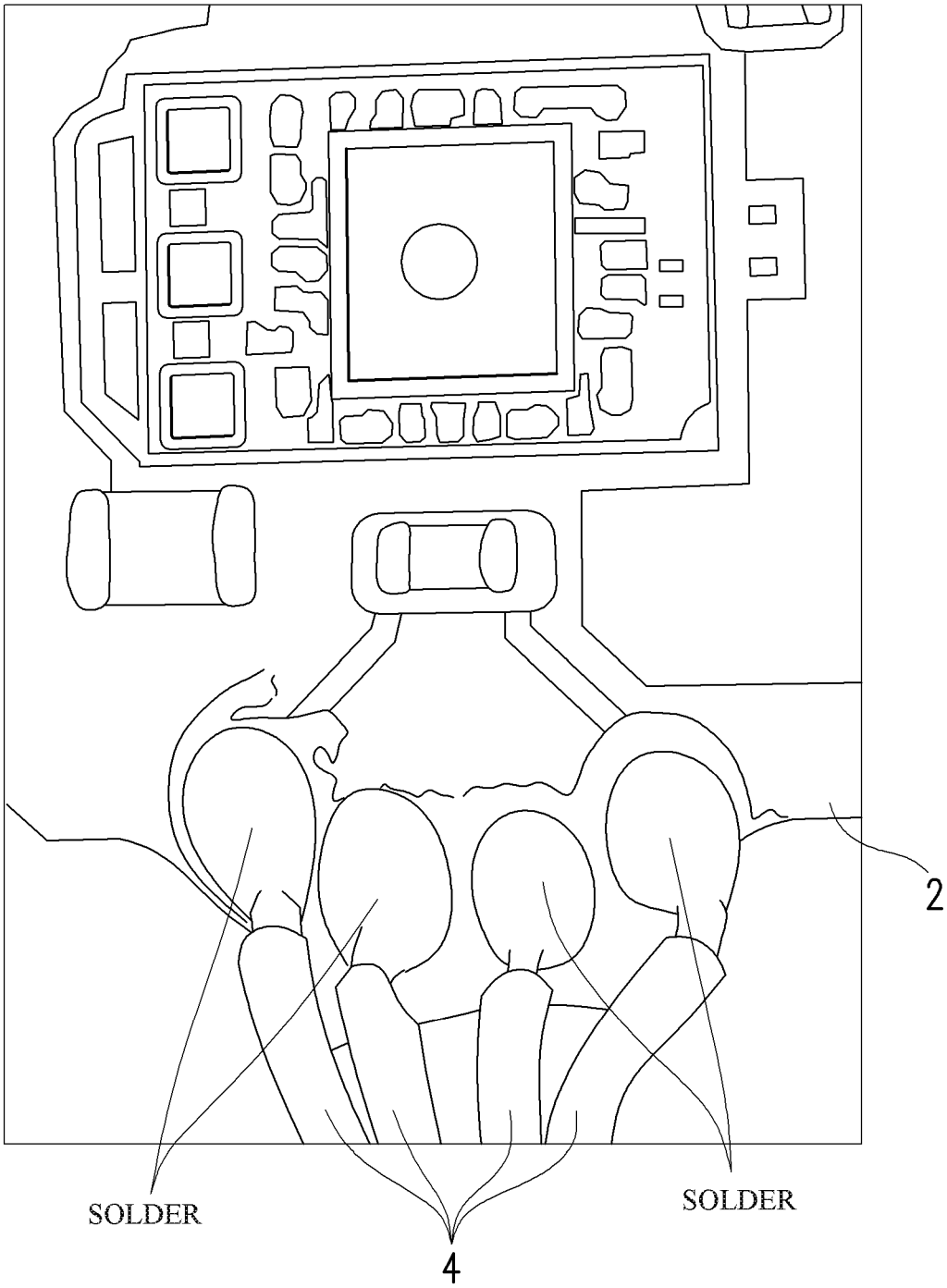
FIG. 20 is a diagram of a conventional sensor shown for comparison with the invention.

Since the sensor 1 of the first embodiment of the invention with the above-described configuration can omit soldering in the step of mounting the strand 4 of the cable 3 on the circuit board 2, the cable 3 can be easily mounted on the circuit board 2. FIG. 20 is a diagram of a conventional sensor shown for comparison with the invention. In the conventional sensor, the strand 4 was directly soldered to the circuit board 2. If the interval between the strands 4 is too narrow, solder may flow to the adjacent strands 4 and cause a short-circuit or the soldering iron may contact with the adjacent strands 4 to cause damage. Further, the quality of soldering and the working time are easily affected by an operator and the appearance, connection reliability, and the like may vary.

In contrast, in the sensor 1 of the first embodiment of the invention, since soldering which tends to vary depending on the operator can be omitted, it is possible to prevent the occurrence of defective products, improve quality, and make them uniform. Since it is possible to assemble even by an unskilled person and shorten the work time, it is possible to decrease a cost. Since it is not necessary to partition a mounting space as large as soldering on the circuit board 2, the strand 4 can be mounted at a high density to decrease the size of the sensor 1.

The connector 10 according to the first embodiment of the invention is formed by a bent metal foil. The pair of first pinching elements 14L and 14R pinches the core wire 6 by the end surface 10C. If the strand 4 is pinched by the first surface 10A or the second surface 10B of the bent metal foil, the metal foil is like to be bent when an external force acts. Accordingly, there is concern that the strand 4 cannot be reliably fixed. Meanwhile, according to the first embodiment, since the strand is pinched by the end surface 10C of the metal foil which is less likely to be deformed, the strand 4 can be reliably fixed. Further, the pinching part 12 is provided at a plurality of positions in the extension direction X of the strand 4. Since the strand 4 is pinched at a plurality of positions, the strand 4 can be more reliably fixed.

In the connector 10 according to the first embodiment of the invention, the pair of first pinching elements 14L and 14R is formed mirror-symmetrically when viewed from the intermediate position of the first pinching elements 14L and 14R. Similarly, the pair of second pinching elements 15L and 15R is formed mirror-symmetrically when viewed from the intermediate position of the second pinching elements 15L and 15R. Even a minute connector 10 does not undergo overly complicated press working due to the simple shape with symmetry. In addition, the connector 10 is formed by a metal foil in which all creases F1, F2, F3, and F4 are bent a plurality of times in the direction Y orthogonal to the extension direction X of the strand 4. Since all creases F1, F2, F3, and F4 are parallel to each other, even a minute connector does not undergo overly complicated press working.

Since each of the first pinching elements 14L and 14R is provided with the receiving part 16 provided at the tips of the first pinching elements 14L and 14R and provided so that the interval D1 of the pair of first pinching elements 14L and 14R becomes narrow as it goes toward the bottom part 11, the strand 4 can be easily aligned. In the receiving part 16, the end surface 10C of the metal foil is formed in a wedge shape. Since the inner covering 7 is cut by the end surface 10C of the receiving part 16 when the strand 4 is pressed into the connector 10, the core wire 6 and the pinching part 12 can be conductive to each other. Therefore, the strand 4 covered with the inner covering 7 can be pressed into the connector 10.

Each of the second pinching elements 15L and 15R is provided with the returning part 17 in which the interval D2 of the pair of second pinching elements 15L and 15R becomes narrow as it goes away from the bottom part 11. The returning part 17 is formed to be narrower than the diameter of the inner covering 7 in a part where the interval D2 is the narrowest. Therefore, it is possible to prevent the strand 4 from coming off from the connector 10 when the inner covering 7 of the strand 4 is disposed to be pinched in the space S2 sandwiched by the pair of second pinching elements 15L and 15R.

Next, the connectors 10 according to second to fourth embodiments of the invention will be described. For the configuration having the same or similar function as the configuration described in the first embodiment, the description of the corresponding first embodiment will be referred to with the same reference numerals and the description thereof will be omitted here. Further, the configurations other than those described below are the same as those of the first embodiment.

Second Embodiment

Figure 9:
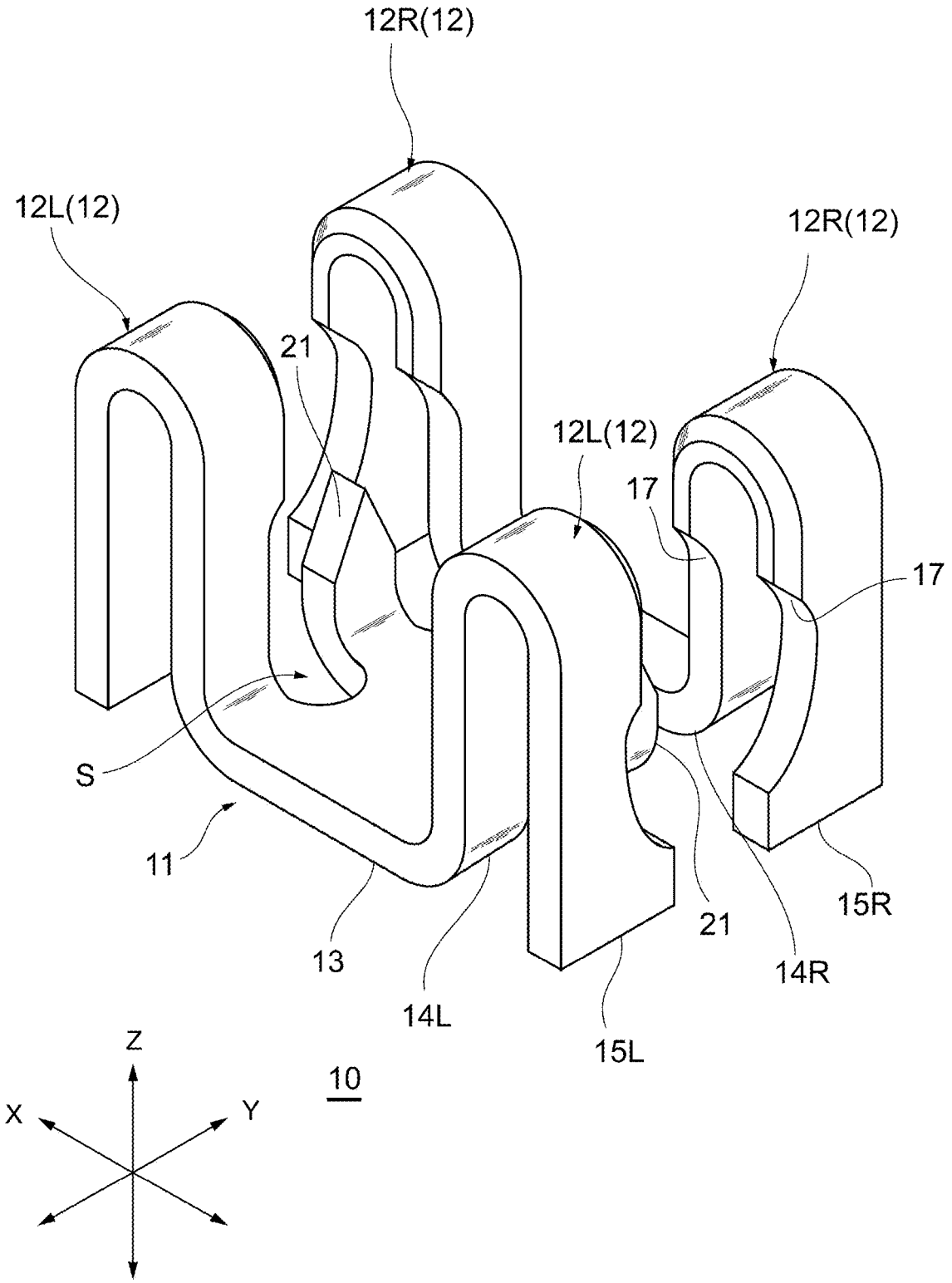
FIG. 9 is a perspective view showing a connector according to a second embodiment of the invention.

The connector 10 according to the second embodiment will be described with reference to FIGS. 9 to 12. FIG. 9 is a perspective view showing the connector 10 according to the second embodiment of the invention. As shown in FIG. 9, the connector 10 according to the second embodiment is different from the first embodiment in that a pressure-contact blade 21 raised upright from the bottom part 11 is provided. In the example shown in the drawings, the pressure-contact blade 21 is raised upright from the bottom plate 13.

Figure 10:
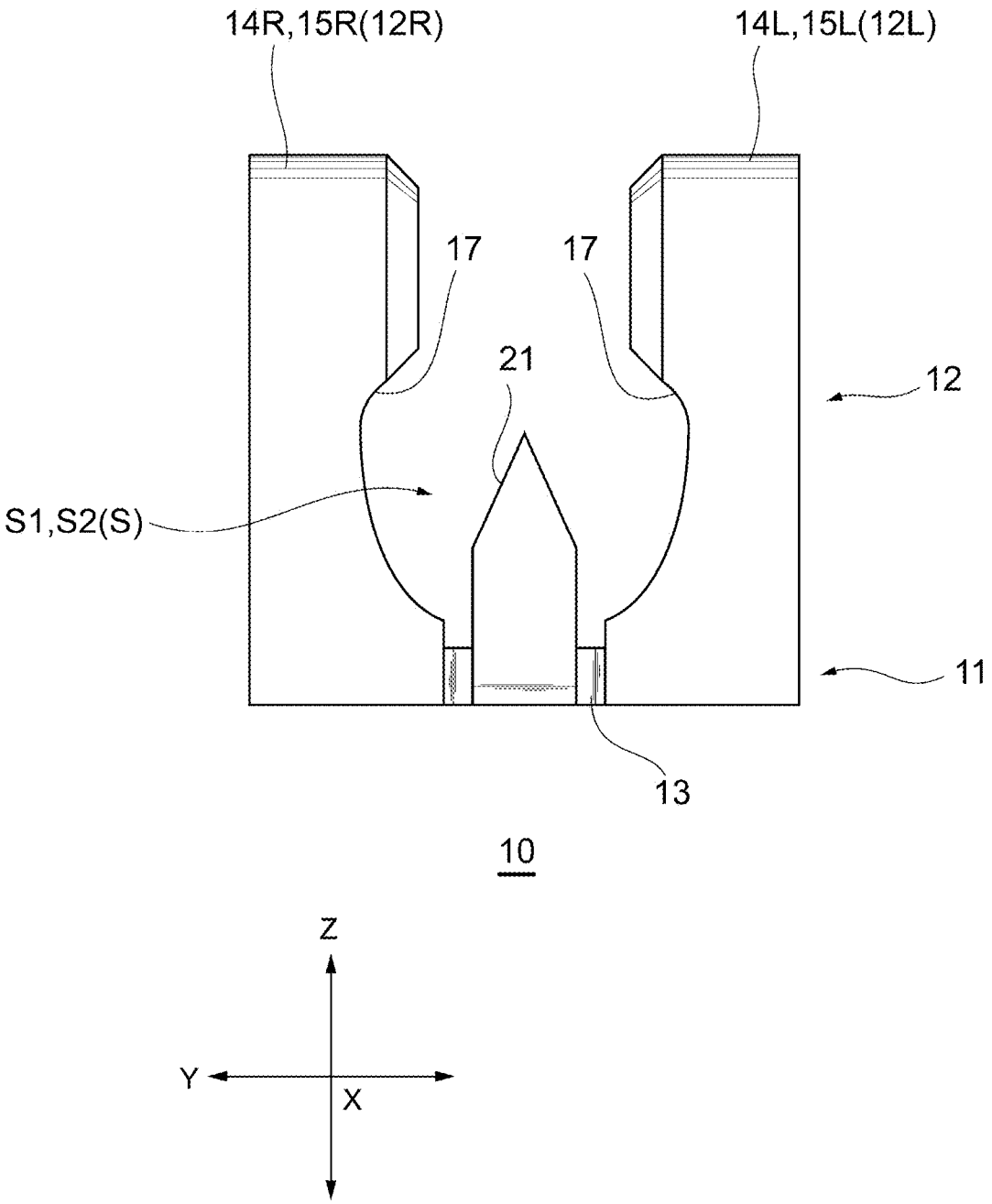
FIG. 10 is a rear view of the connector shown in FIG. 9.
Figure 11:
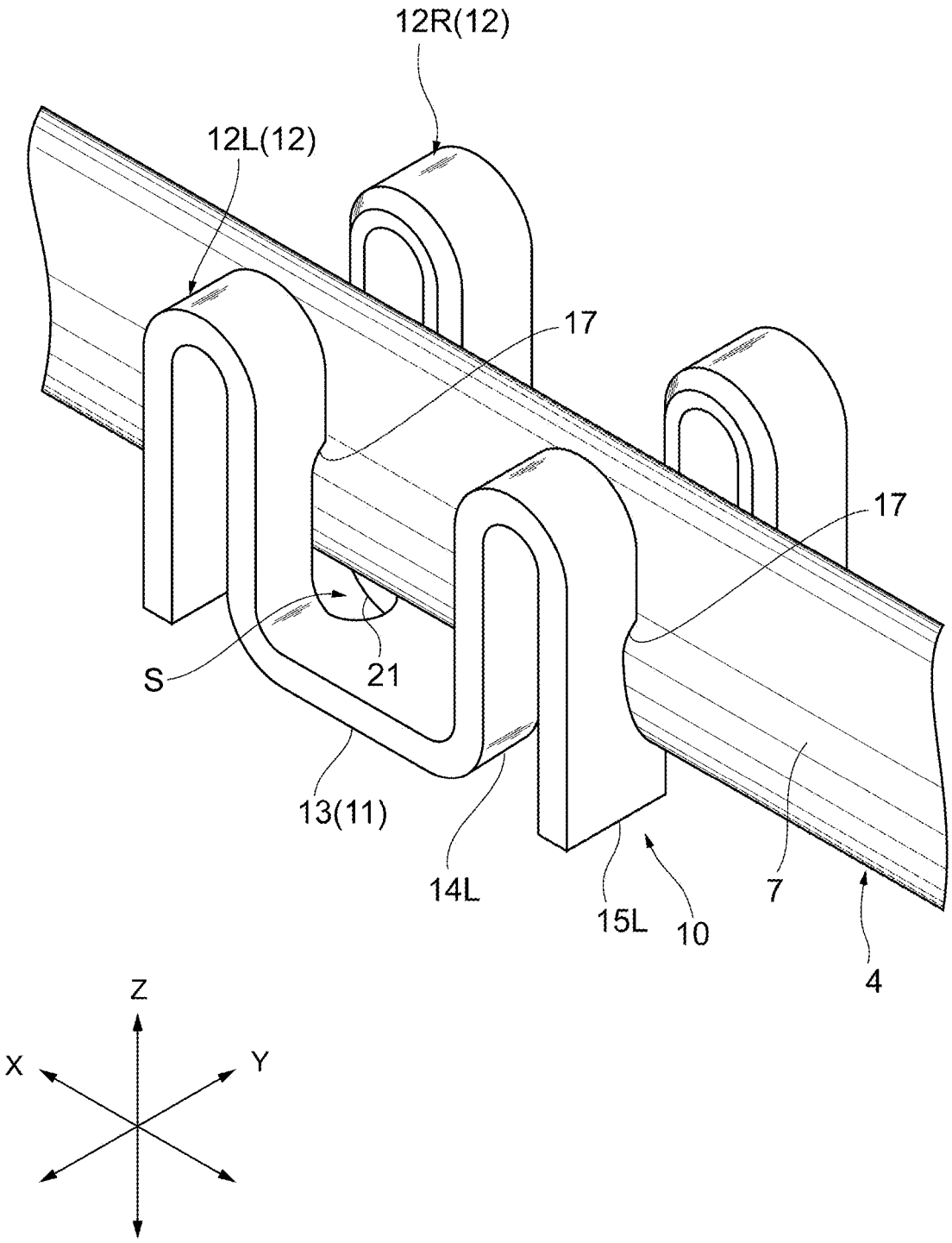
FIG. 11 is a perspective view showing a usage example of the connector according to the second embodiment of the invention.

FIG. 10 is a rear view in which the connector 10 is viewed from the tip side in the extension direction X of the strand 4. As shown in FIG. 10, when the circuit board 2 is placed on a horizontal plane, the pressure-contact blade 21 protrudes upward. In the second embodiment, the first pinching elements 14L and 14R are provided with the returning part 17 instead of the receiving part 16. FIG. 11 is a perspective view showing a usage example of the connector 10 according to the second embodiment of the invention.

Figure 12:
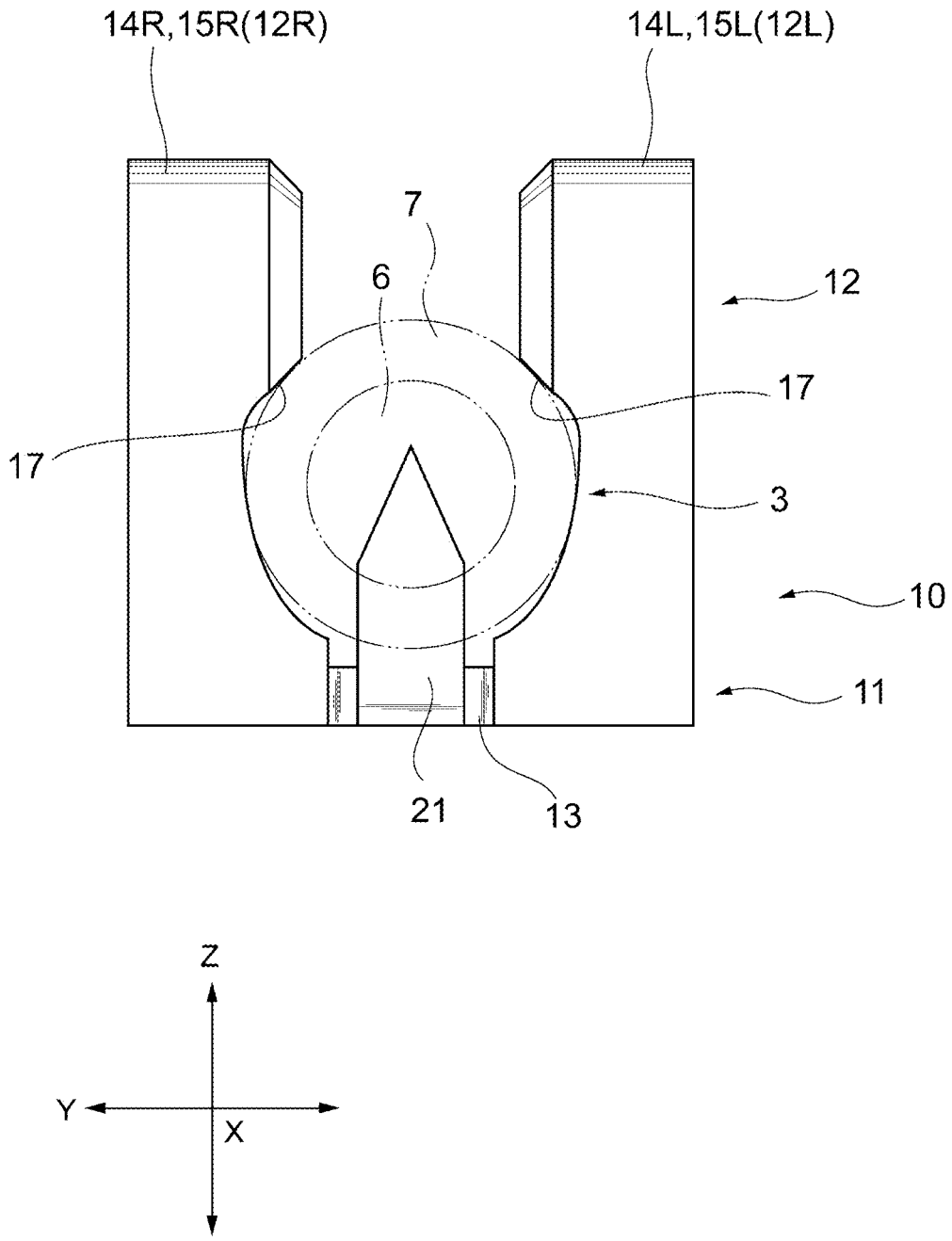
FIG. 12 is a rear view transparently showing a part of a strand mounted on the connector.

FIG. 12 is a rear view transparently showing a part of the strand mounted on the connector. As shown in FIG. 12, when the strand 4 is pressed into the connector 10, the inner covering 7 is cut by the pressure-contact blade 21. In the state in which the strand 4 is mounted on the connector 10, the pressure-contact blade 21 penetrates the inner covering 7 to be conductive to the core wire 6. According to the sensor 1 of the second embodiment, since the pressure-contact blade 21 penetrating the inner covering 7 to be conductive to the core wire 6 is provided, the strand 4 covered with the inner covering 7 can be pressed into the connector 10.

Third Embodiment

The connector 10 according to the third embodiment will be described with reference to FIGS. 13 to 15B. The connector 10 according to the third embodiment is different from the first embodiment in that the strand 4 is not fixed in the state shown in FIGS. 14A to 15A in which the connector 10 is not tightened and the strand 4 is pinched by the pair of pinching elements 12L and 12R in the state shown in FIG. 15B in which the connector 10 is tightened.

Figure 13:
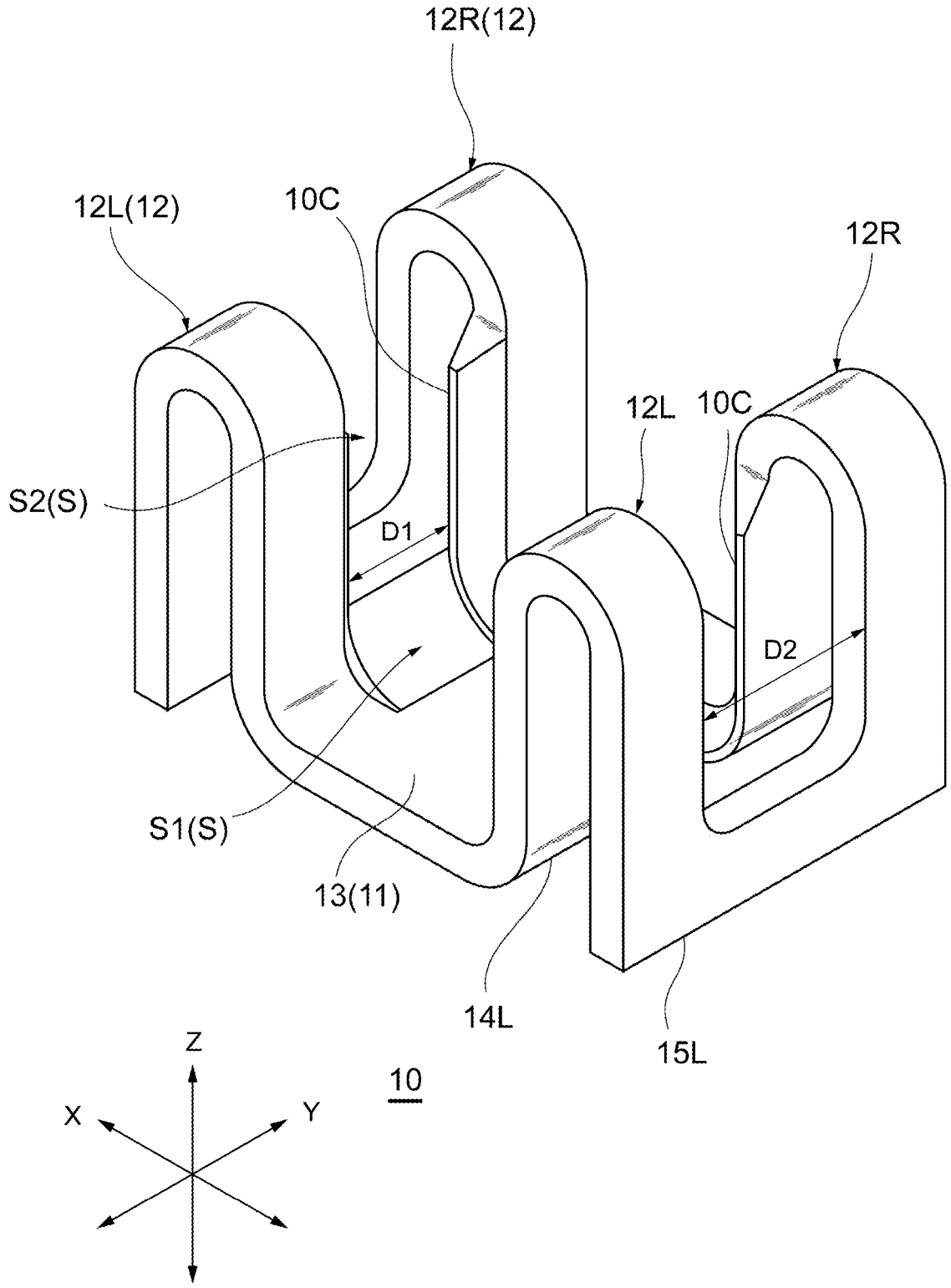
FIG. 13 is a perspective view showing a connector according to a third embodiment of the invention.

FIG. 13 is a perspective view showing the connector 10 according to the third embodiment of the invention. As shown in FIG. 13, in the third embodiment, neither the receiving part 16 nor the returning part 17 is provided on the connector 10. The interval D1 of the pair of first pinching elements 14L and 14R is formed to be substantially the same from the end part on the side of the bottom part 11 to the end part on the side opposite to the bottom part 11. Similarly, the interval D2 of the pair of second pinching elements 15L and 15R is formed to be substantially the same from the vicinity of the end part on the side of the bottom part 11 to the end part on the side opposite to the bottom part 11. In the example shown in the drawings, the end parts of the pair of second pinching elements 15L and 15R on the side of the bottom part 11 are connected.

Figure 14A:
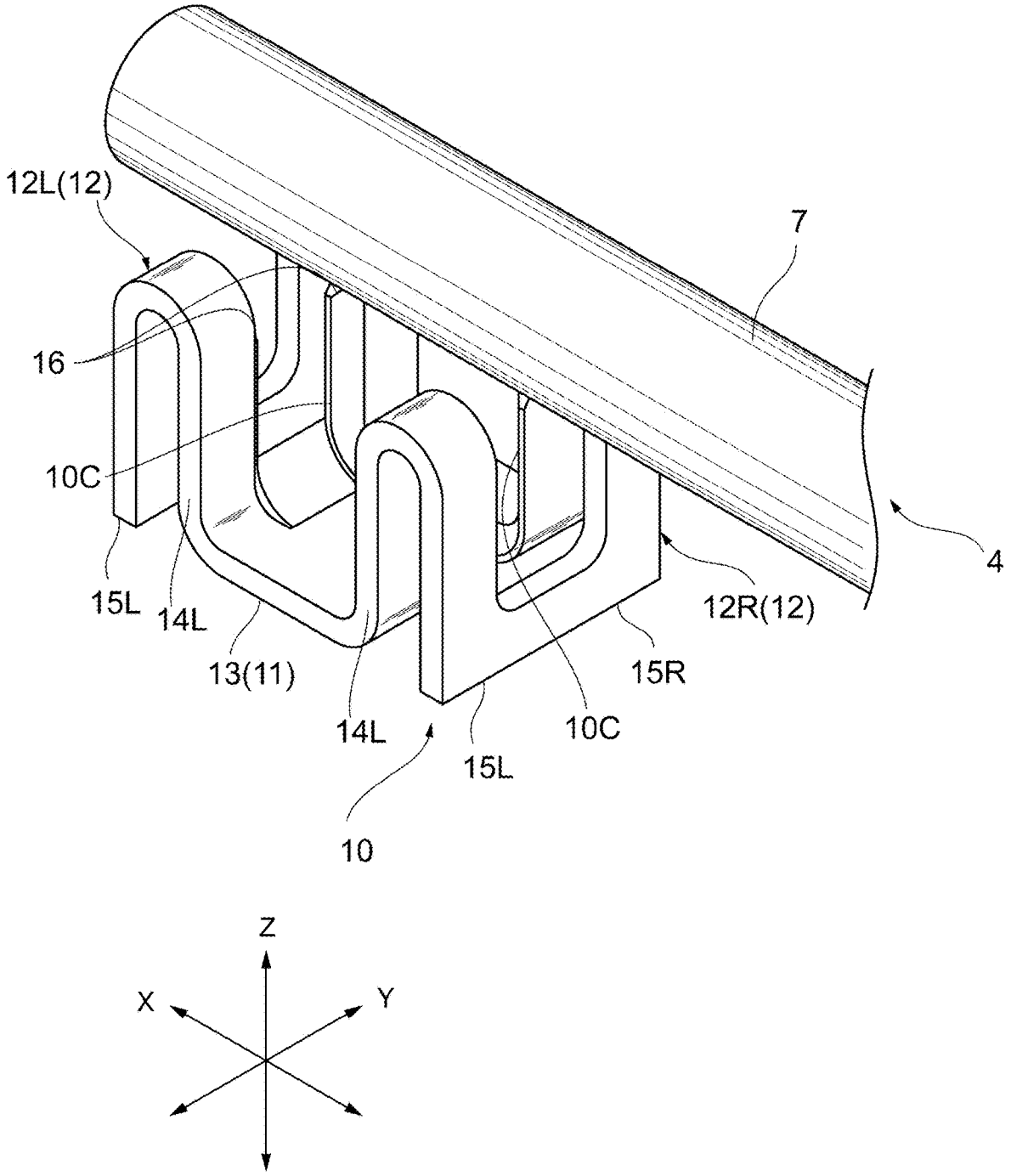
FIG. 14A is a perspective view showing a usage example of the connector according to the third embodiment of the invention.
Figure 14B:
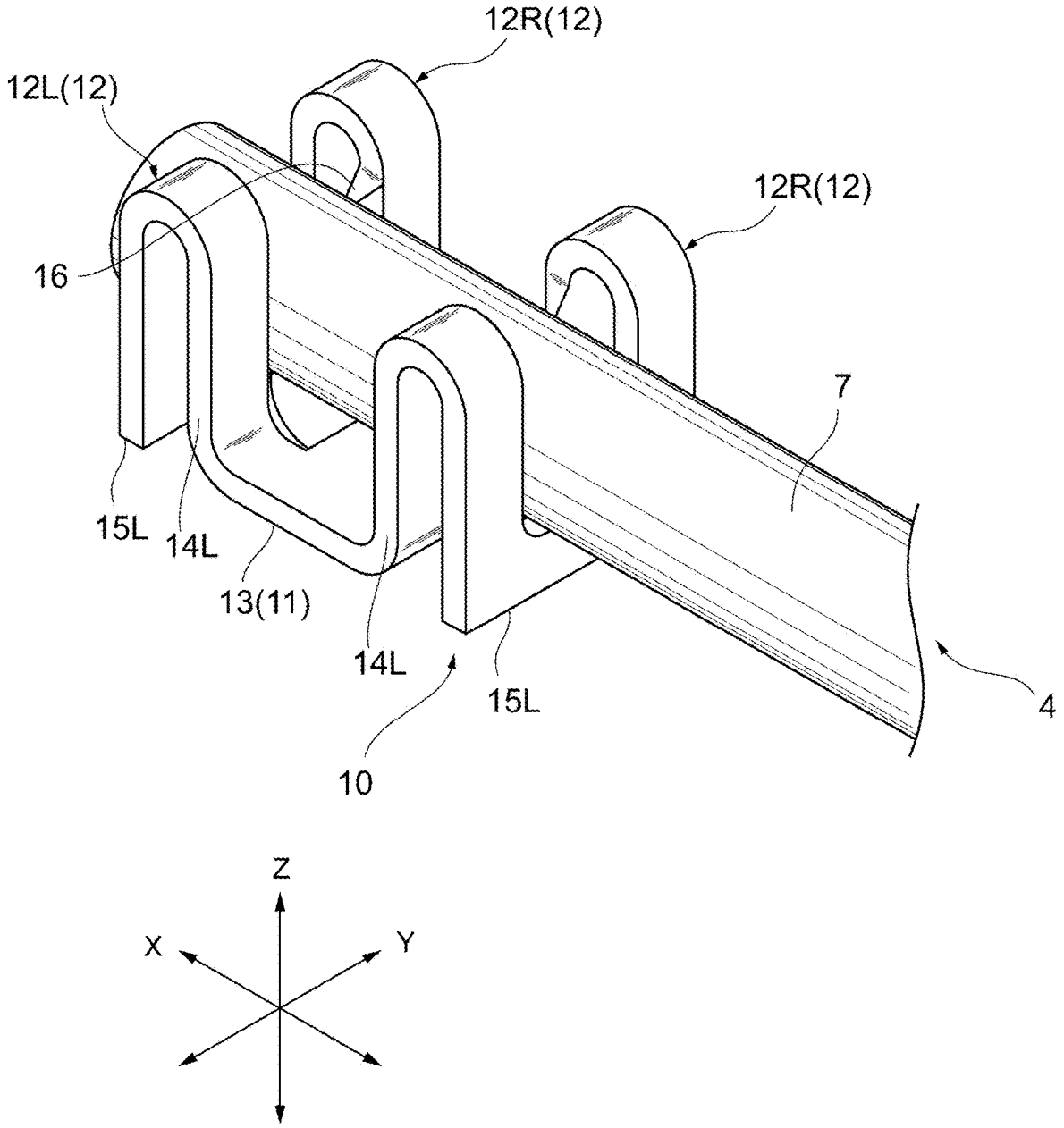
FIG. 14B is a perspective view showing a usage example of the connector according to the third embodiment of the invention after FIG. 14A.
Figure 15A:
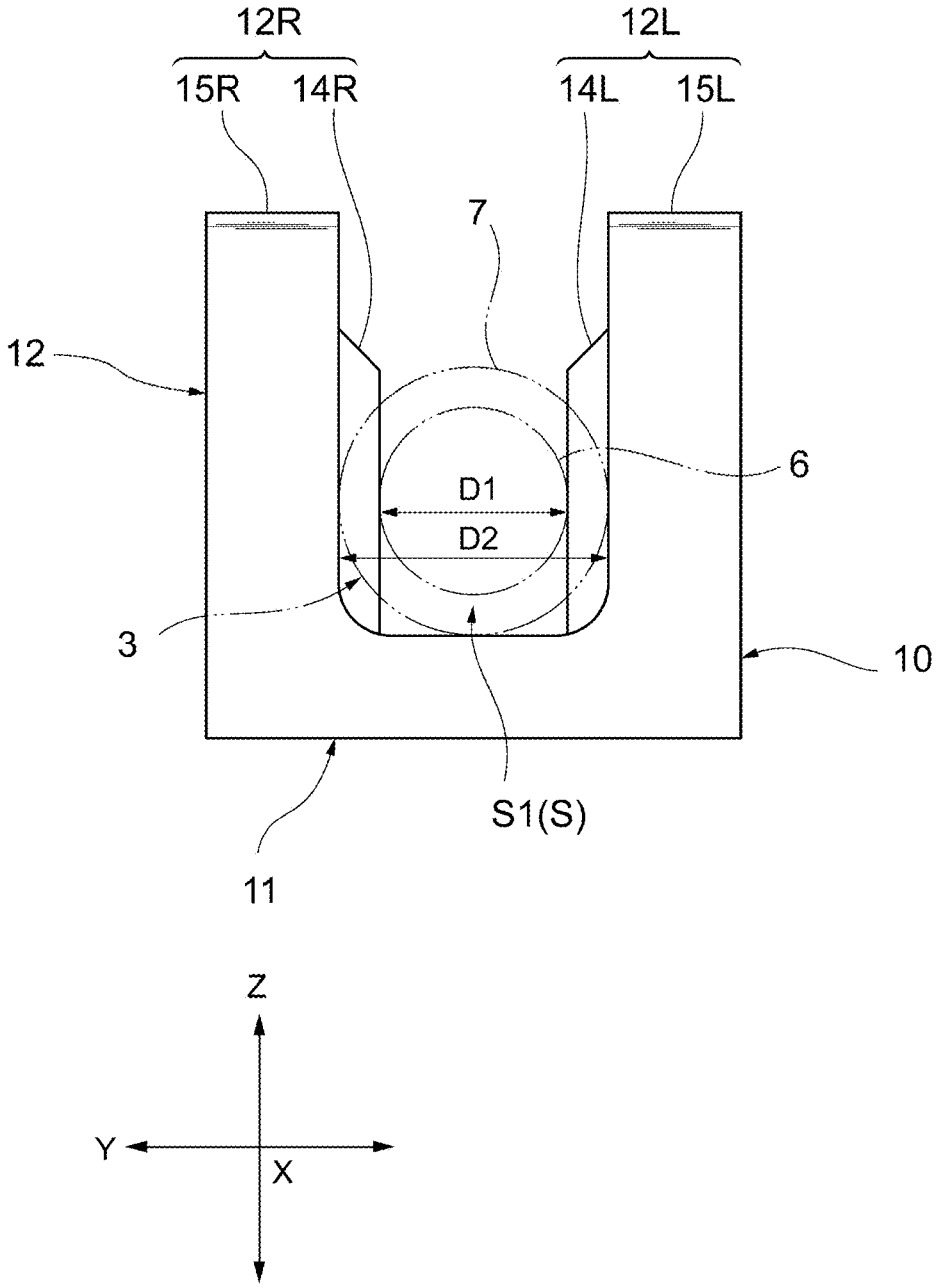
FIG. 15A is a rear view transparently showing a part of the connector and the strand shown in FIG. 14B.
Figure 15B:
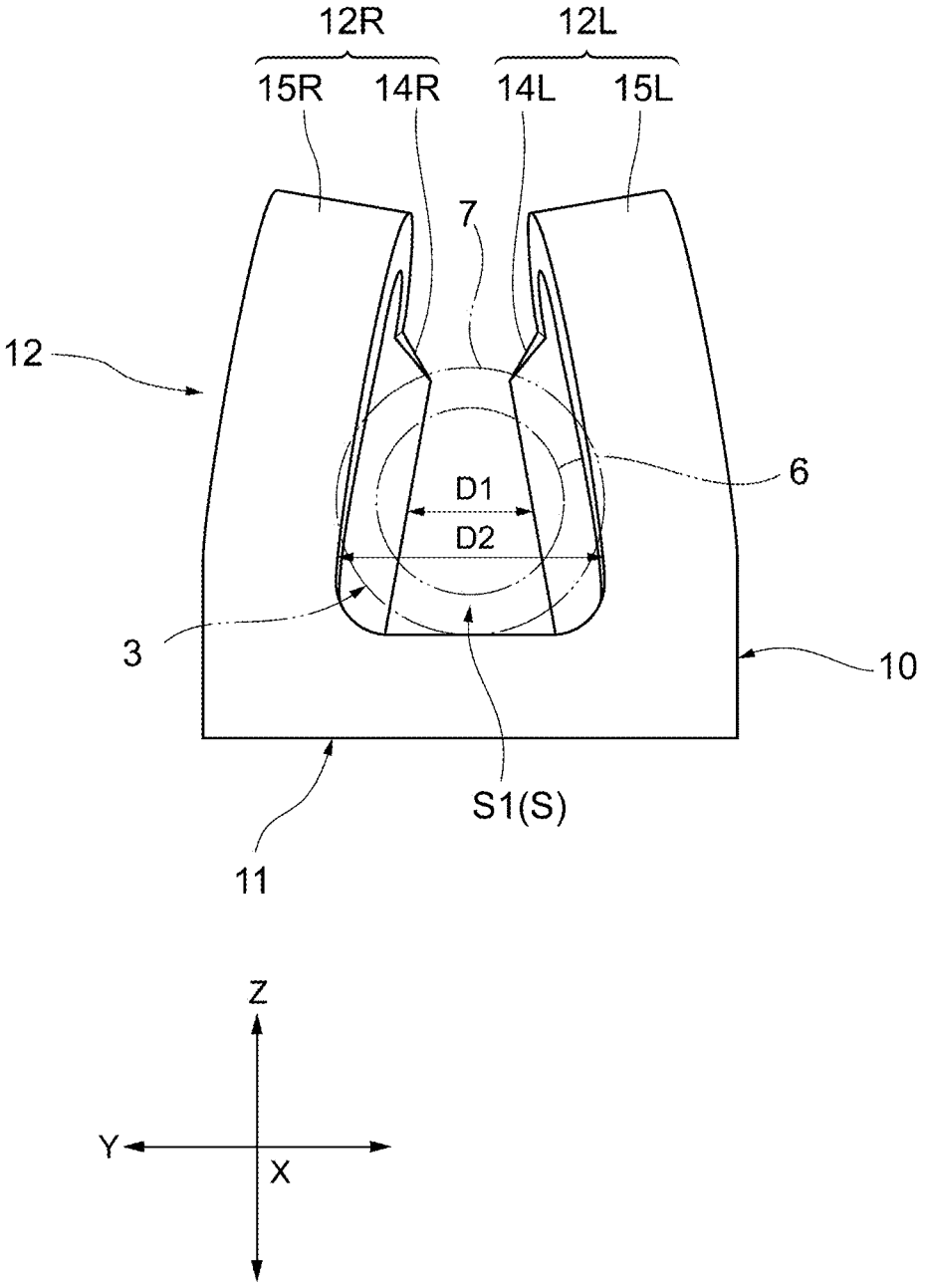
FIG. 15B is a rear view showing a usage example of the connector according to the third embodiment of the invention after FIG. 15A.

In one or both of the first and second pinching elements 14L, 14R, 15L, and 15R, the end surface 10C pinching the strand 4 is formed in a wedge shape and functions as a pressure-contact blade. In the example shown in the drawings, the end surface 10C of the metal foil of the first pinching elements 14L and 14R is formed in a wedge shape. FIGS. 14A and 14B are perspective views showing a usage example of the connector 10 according to the third embodiment of the invention. FIG. 15A is a rear view transparently showing a part of the connector 10 and the strand 4 shown in FIG. 14B. FIG. 15B is a diagram showing a state in which the connector 10 shown in FIG. 15A is tightened. As shown in FIGS. 13A to 15A, the interval D1 of the pair of first pinching elements 14L and 14R is formed to be substantially the same as or slightly narrower than the diameter of the core wire 6 in the state in which the connector 10 is not tightened.

When the strand 4 is fixed to the connector 10, as shown in FIG. 15B, the connector 10 is tightened so that the interval D1 of the first pinching elements 14L and 14R becomes narrow and the core wire 6 is pinched by the pair of first pinching elements 14L and 14R. Additionally, the end surfaces 10C of the second pinching elements 15L and 15R can be formed in a wedge shape and the core wire 6 can be pinched by the pair of second pinching elements 15L and 15R.

According to the sensor 1 of the third embodiment, the strand 4 can be freely moved and aligned in the state shown in FIGS. 14A to 15A in which the connector 10 is not tightened. Since it is not necessary to press the strand 4 into the connector 10 against the frictional resistance and the restoring force of the pinching part 12, the burden on the operator can be reduced. Since the pair of pinching elements 12L and 12R which is irreversibly deformed bites into the core wire 6 in the state shown in FIG. 15B in which the connector 10 is tightened, the strand 4 is reliably pinched by the connector 10. Since the end surface 10C is formed in a wedge shape, the first pinching elements 14L and 14R penetrate the inner covering 7 to be conductive to the core wire 6. Additionally, the pressure-contact blade formed on the end surface 10C can be omitted when using the strand 4 in which the inner covering 7 at the tip is cut in advance (see FIG. 8).

Fourth Embodiment

The connector 10 according to the fourth embodiment will be described with reference to FIGS. 16 to 18. The connector 10 according to the fourth embodiment includes pressure-contact blades 41 and 42 which are provided in the pinching elements 12L and 12R. This embodiment is different from the first embodiment in that the strand 4 is not fixed in the state shown in FIG. 17A in which the connector 10 is not tightened and the strand 4 is fixed in the state shown in FIG. 17B in which the connector 10 is tightened.

Figure 16:
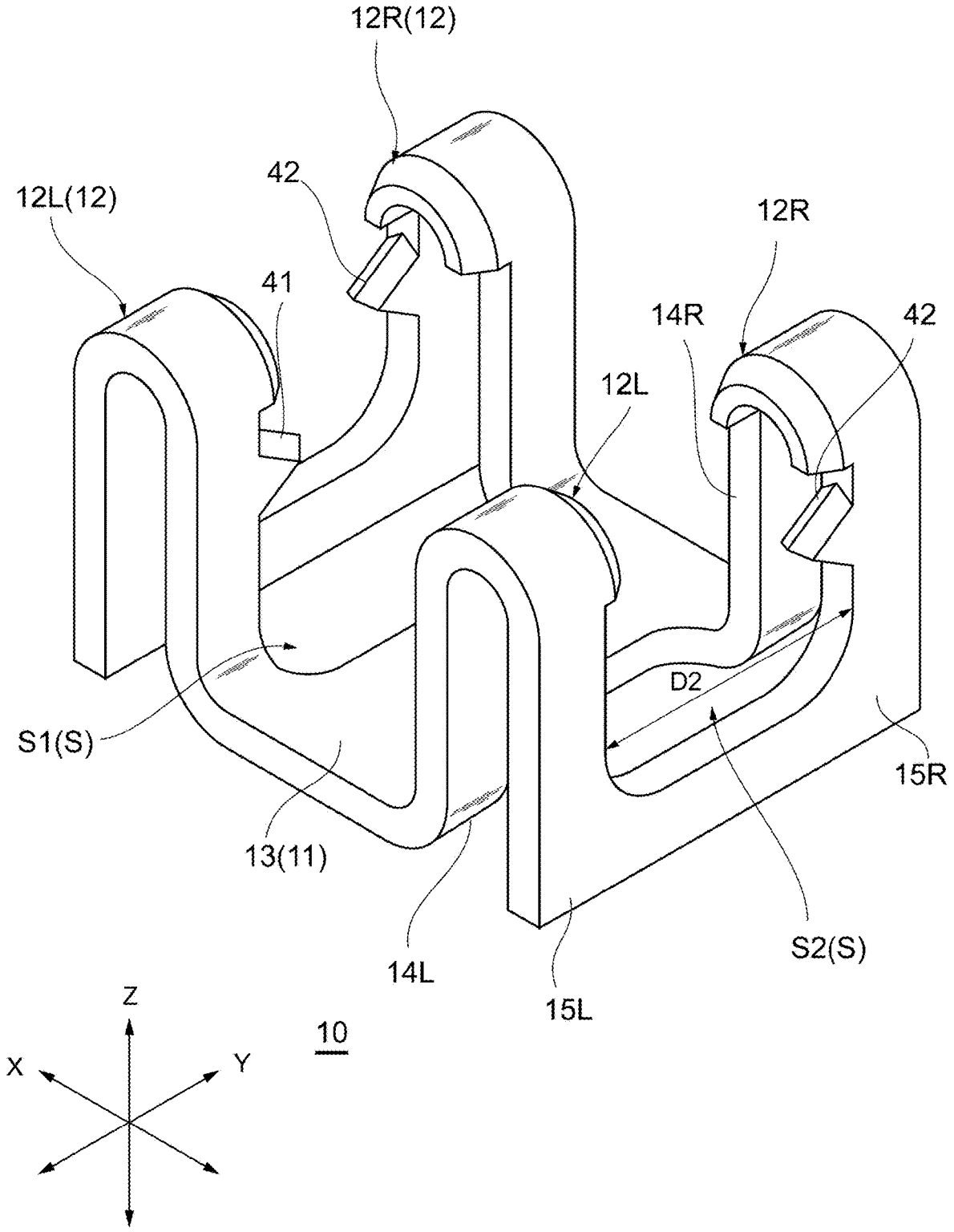
FIG. 16 is a perspective view showing a connector according to a fourth embodiment of the invention.

FIG. 16 is a perspective view showing the connector 10 according to the fourth embodiment of the invention. In the example shown in the drawings, the first pinching element 14L is provided with the pressure-contact blade 41 and the second pinching element 15R is provided with the pressure-contact blade 42. The pressure-contact blade 41 provided in one first pinching element 14L protrudes toward the other first pinching element 14R. Similarly, the pressure-contact blade 42 provided in the other second pinching element 15R protrudes toward one second pinching element 15L.

Additionally, the pressure-contact blade provided in the pinching part 12 may be any one of the pressure-contact blades 41 and 42. The pressure-contact blade 41 may be provided in the other first pinching element 14R or may be provided in both first pinching elements 14L and 14R. Similarly, the pressure-contact blade 42 may be provided in one second pinching element 15L or may be provided in both second pinching elements 15L and 15R.

As shown in FIG. 16, in the fourth embodiment, neither the receiving part 16 nor the returning part 17 is provided in the connector 10*h*. The interval D1 of the pair of first pinching elements 14L and 14R is formed to be substantially the same in the thickness direction Z of the circuit board 2. Similarly, the interval D2 of the pair of second pinching elements 15L and 15R is formed to be substantially the same in the thickness direction Z of the circuit board 2.

Figure 17A:
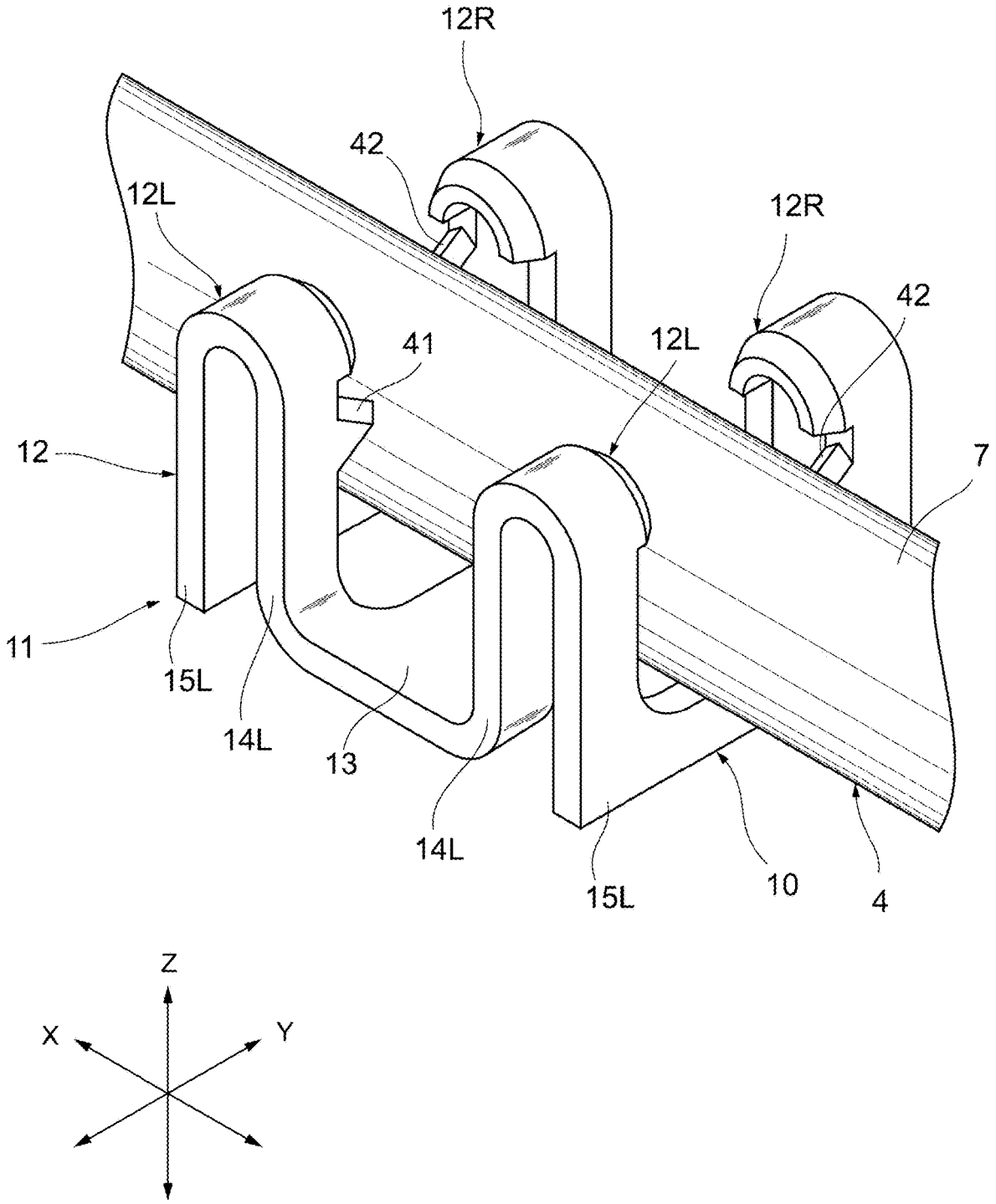
FIG. 17A is a perspective view showing a usage example of the connector according to the fourth embodiment of the invention.
Figure 17B:
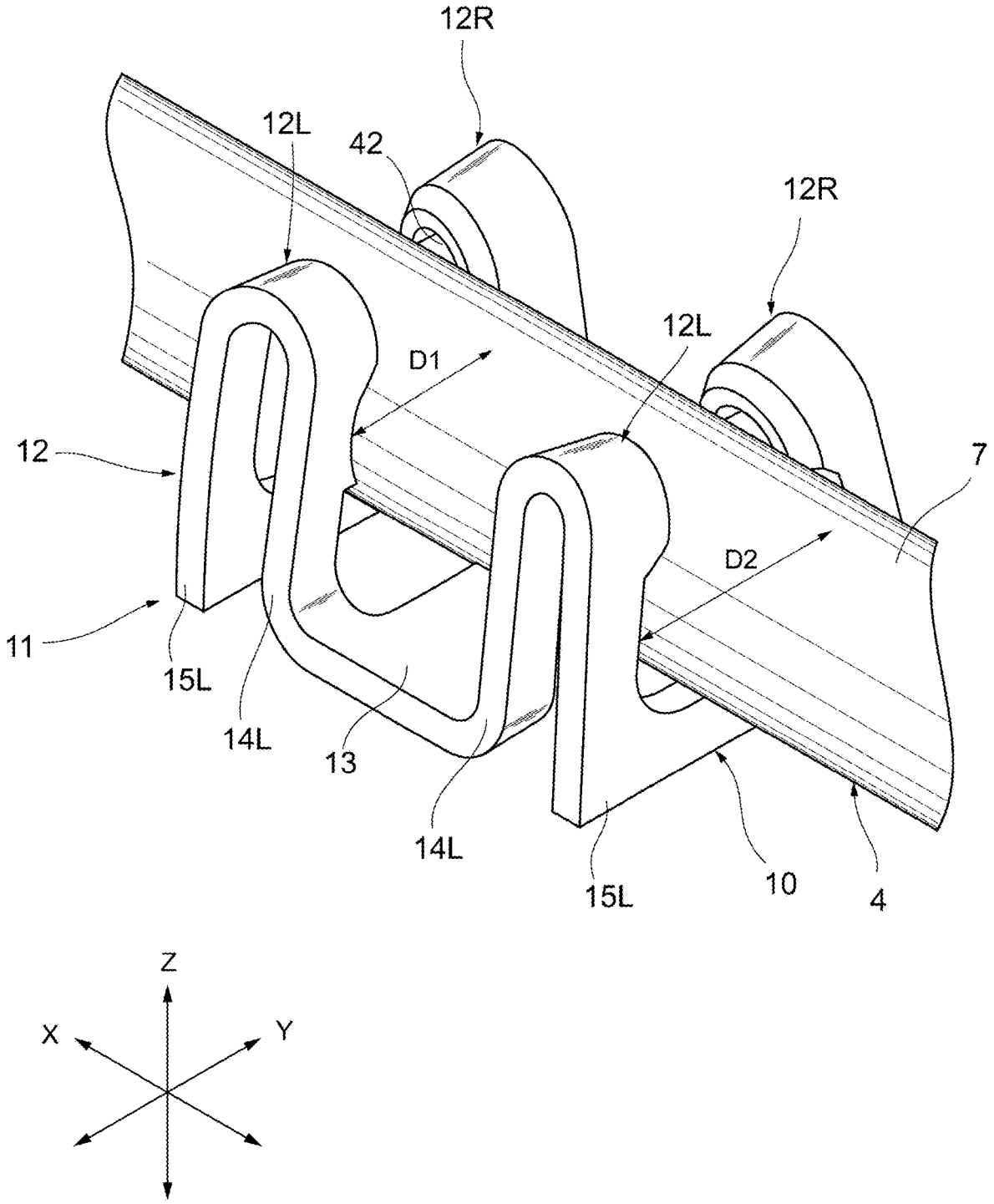
FIG. 17B is a perspective view showing a usage example of the connector according to the fourth embodiment of the invention after FIG. 17A.

FIGS. 17A and 17B are perspective views showing a usage example of the connector 10 according to the fourth embodiment of the invention. As shown in FIG. 17A, the intervals D1 and D2 of the pair of pinching elements 12L and 12R are formed to be substantially the same as the diameter of the inner covering 7 in the state in which the connector 10 is not tightened. When the strand 4 is fixed to the connector 10, as shown in FIG. 17B, the connector 10 is tightened so that the intervals D1 and D2 of the pair of pinching elements 12L and 12R become narrow and the strand 4 is pinched by the pinching part 12.

Figure 18:
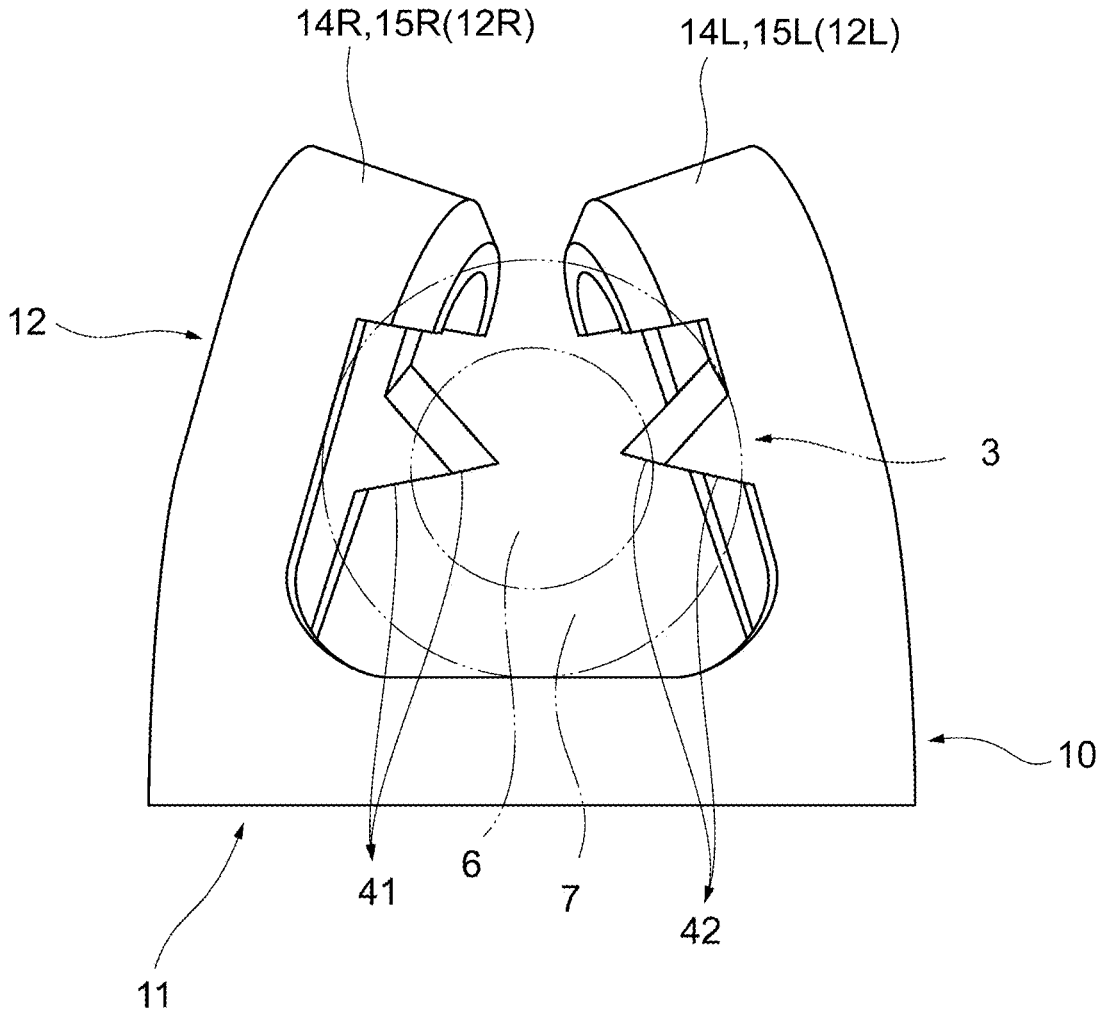
FIG. 18 is a rear view transparently showing a part of the strand mounted on the connector.

FIG. 18 is a rear view transparently showing a part of the strand 4 mounted on the connector 10. As shown in FIG. 18, the pressure-contact blades 41 and 42 penetrate the inner covering 7 to be conductive to the core wire 6 in the state in which the connector 10 is tightened. According to the sensor 1 of the fourth embodiment, since the pressure-contact blades 41 and 42 of the pair of pinching elements 12L and 12R which is irreversibly deformed bite into the strand 4, the strand 4 is reliably pinched by the connector 10. Since the pressure-contact blade 21 penetrating the inner covering 7 to be conductive to the core wire 6 is provided, there is no need to expose the core wire 6 by cutting the inner covering 7 at the tip of the strand 4 and cover the core wire 6 with the solder layer.

Figure 19:
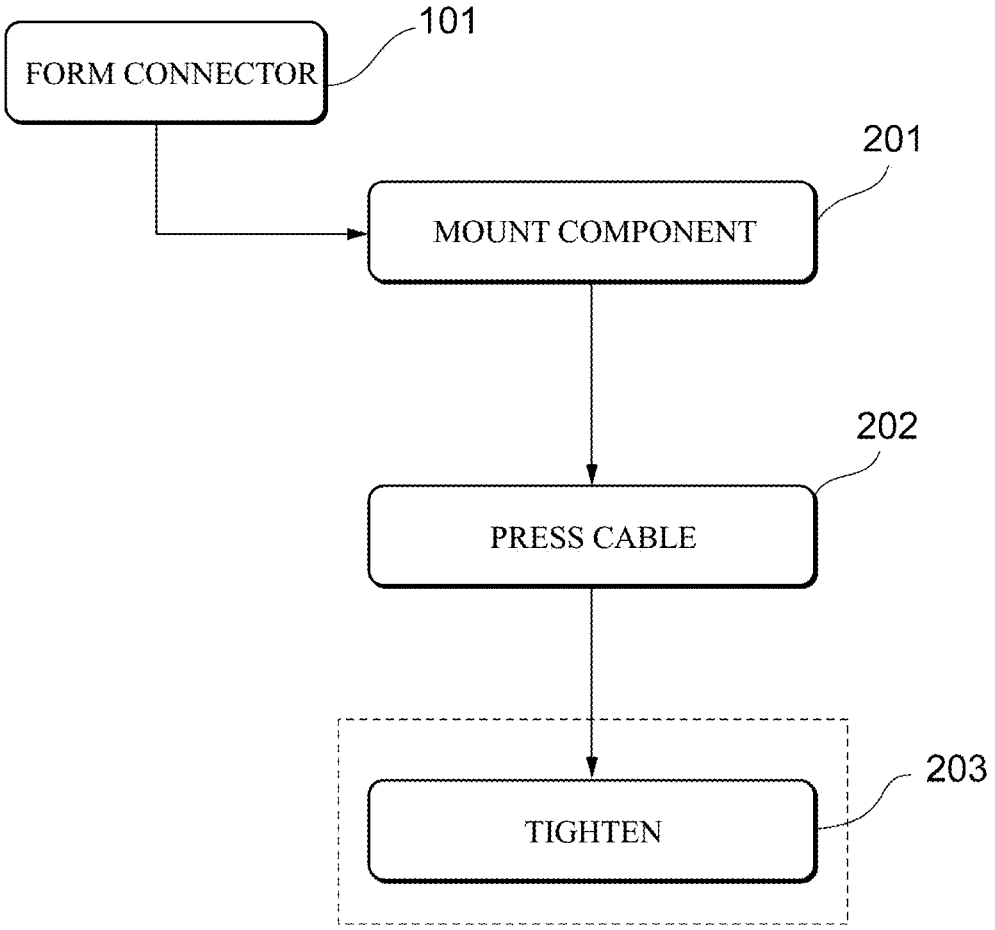
FIG. 19 is a flowchart showing an example of a procedure of mounting the strand in the invention.

Next, a method of manufacturing the sensor 1 of the invention will be described. FIG. 19 is a flowchart showing an example of a procedure of mounting the cable 3 of the invention. In the method of manufacturing the sensor 1 of the invention, the connector 10 is composed of a conductive material such as a metal foil in a first step indicated by reference numeral 101. In a second step indicated by reference numeral 201, an electronic component such as a sensor element and the connector 10 are automatically mounted on the circuit board 2 using a solder printing machine, a component mounting machine, and a reflow furnace.

In a third step indicated by reference numeral 202, the strand 4 is pressed into the connector 10 and the strand 4 is pinched by the pinching part 12. In the case of the sensor 1 of the first and second embodiments, the strand 4 is mounted on the circuit board 2 via the connector 10 at this time point. In the case of the sensor 1 of the third and fourth embodiments, the strand 4 is mounted on the circuit board 2 via the connector 10 when the connector 10 is tightened and the strand 4 is completely fixed in a fourth step indicated by reference numeral 203.

Figure 21:
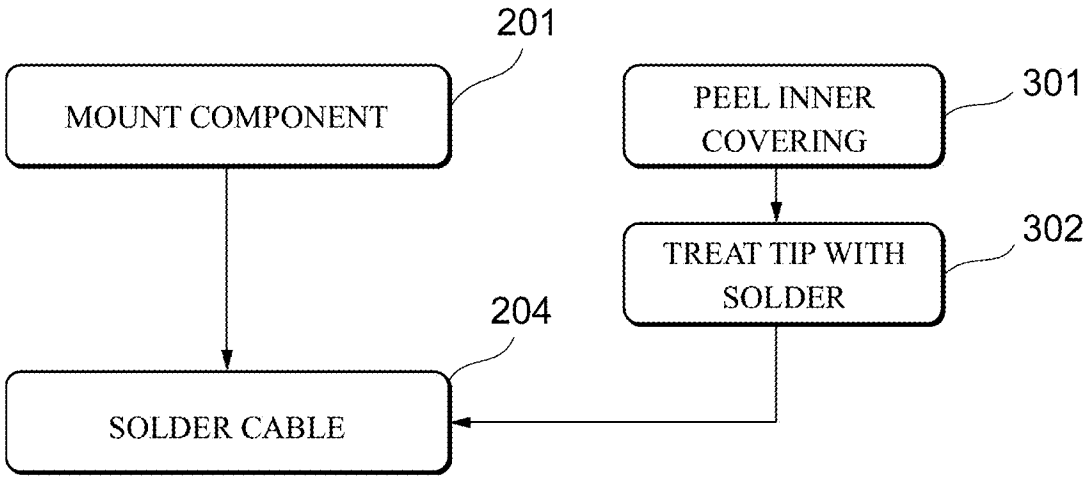
FIG. 21 is a flowchart showing an example of a procedure of mounting the strand in the conventional example shown in FIG. 20.

FIG. 21 is a flowchart showing an example of a procedure of mounting the cable 3 of a conventional example. In the conventional sensor manufacturing method, an operator manually soldered the strand 4 to the circuit board 2 in a step indicated by reference numeral 204. As described so far, in the ultra-small sensor 1, it is a heavy burden on the operator to solder the strand 4 to the narrow mounting space of the circuit board 2. According to the method of manufacturing the sensor 1 of the invention, the heavy load step 204 can be replaced with the light load steps 202 and 203.

Further, in the conventional sensor manufacturing method, the operator manually cut off the inner covering 7 at the tip of the strand 4 using a wire stripper in a step indicated by reference numeral 301. In a fifth step indicated by reference numeral 302, the operator manually covered the core wire 6 with a solder layer so that the conductive wire would not spread. According to the method of manufacturing the sensor 1 of the invention, such a manual step can also be omitted. Additionally, the pressure-contact blade penetrating the inner covering 7 is not a configuration essential for the connector 10 and can be omitted. In that case, for example, the inner covering 7 of the tip of the strand 4 may be cut by the steps 301 and 302.

The embodiments described above are for facilitating the understanding of the invention and are not for limiting the interpretation of the invention. Each element included in the embodiment and its arrangement, material, condition, shape, size, and the like are not limited to those exemplified and can be changed as appropriate. In addition, the configurations shown in different embodiments can be partially replaced or combined.

[Appendix 1]

A sensor (1) including:

a circuit board;

a connector (10) which is composed of a metal material and is fixed to the circuit board (2); and a cable (3) which is connected to the circuit board (2) via the connector (10), wherein the connector (10) includes a bottom part (11) connected to the circuit board (2) and a pair of pinching elements (12L, 12R) raised upright from the bottom part (11), and wherein the cable (3) is pinched in a space (S) sandwiched by the pair of pinching elements (12L, 12R).

[Appendix 2]

A method of manufacturing a sensor (1) including:

a first step (101) of forming a connector (10) including a bottom part (11) and a pair of pinching elements (12L, 12R) raised upright from the bottom part (11) using a metal material;

a second step (201) of connecting the connector (10) to a circuit board (2); and a third step (202) of pressing a cable (3) toward the bottom part (11) and holding the cable (3) in a space (S) between the pair of pinching elements (12L, 12R).

The invention claimed is:

1. A sensor comprising:

a circuit board;

a connector which is composed of a metal material and which is fixed to the circuit board; and a cable which is connected to the circuit board via the connector, wherein the cable includes a plurality of strands and an outer covering bundling the plurality of strands, and each of the strands includes a core wire and an inner covering the core wire, wherein the connector includes:

a bottom part, comprising a base, connected to the circuit board;

a first pinching part, comprising a first pair of protrusions raised upright from the bottom part and bent back towards the bottom part forming a first pair of substrates extending substantially parallel to the first pair of protrusions; and a second pinching part, comprising a second pair of protrusions raised upright from the bottom part, wherein the cable is pinched in a space sandwiched by the second pair of protrusions, and wherein the cable is pinched in a space sandwiched by the first pair of protrusions wherein the first pair of substrates further includes a returning part provided so that an interval of the first pair of substrates becomes narrow as it goes away from the bottom part, and wherein the returning part is formed to be narrower than a diameter of the inner covering in a portion in which the interval of the first pair of substrates is the narrowest.

2. The sensor according to claim 1, wherein the first pair of protrusions is formed mirror-symmetrically when viewed from an intermediate position of the first pair of protrusions.

3. The sensor according to claim 1, wherein the connector is formed by a bent metal foil, wherein the metal foil includes a first surface, a second surface on a side opposite to the first surface, and an end surface connecting the first surface and the second surface, wherein the end surface faces the space sandwiched by the first pair of protrusions, and wherein the first pair of protrusions pinches the cable by using the end surface.

4. The sensor according to claim 3, wherein the connector is formed of the metal foil bent a plurality of times so that all creases are orthogonal to an extension direction of the cable.

5. The sensor according to claim 4, wherein in the bottom part, the second surface is connected to the circuit board, wherein the second surface of the first pair of protrusions faces the second surface of the first pair of substrates.

6. The sensor according to claim 5, wherein the cable includes a plurality of strands and an outer covering bundling the plurality of strands, wherein each of the strands includes a core wire composed of a plurality of conductive wires and an inner covering covering the core wire, wherein the first pair of protrusions pinches the core wire, and wherein the first pair of substrates pinches the inner covering.

7. The sensor according to claim 6, wherein the first pair of protrusions includes a receiving part provided at a tip of the first pair of protrusions and provided so that an interval of the first pair of protrusions becomes narrow as it goes toward the bottom part.

8. The sensor according to claim 7, wherein the end surface of the first pair of protrusions in the receiving part is formed in a wedge shape.

9. The sensor according to claim 5, wherein the core wire is composed of a plurality of conductive wires, wherein all of the first pair of protrusions and the first pair of substrates pinch the inner covering, and wherein at least one of the bottom part, the first pair of protrusions, and the first pair of substrates includes a pressure-contact blade that penetrates the inner covering and is conductive to the core wire.

10. The sensor according to claim 9, wherein each of the first pair of protrusions and the first pair of substrates includes the pressure-contact blade, and wherein a plurality of pressure-contact blades penetrate the inner covering while the connector is tightened so that the interval of the first pair of protrusions becomes narrow and the interval of the first pair of substrates becomes narrow.

11. A sensor manufacturing method comprising:

a first step of forming a connector including a bottom part and a first pair of protrusions raised upright from the bottom part and bent back towards the bottom part forming a first pair of substrates extending substantially parallel to the first pair of protrusions by a metal material;

a second step of connecting the connector to a circuit board; and a third step of pressing a cable toward the bottom part and pinching the cable in a space sandwiched between the first pair of protrusions, wherein the cable includes a plurality of strands and an outer covering bundling the plurality of strands, and each of the strands includes a core wire and an inner covering the core wire, the first pair of substrates further includes a returning part provided so that an interval of the first pair of substrates becomes narrow as it goes away from the bottom part, and the returning part is formed to be narrower than a diameter of the inner covering in a portion in which the interval of the first pair of substrates is the narrowest, wherein the cable includes a plurality of strands and an outer covering bundling the plurality of strands, wherein each of the strands includes a core wire composed of a plurality of conductive wires and an inner covering the core wire, wherein the connector further includes a pressure-contact blade provided in the bottom part, and wherein in the third step, the pressure-contact blade penetrates the inner covering to be conductive to the core wire.

12. The sensor manufacturing method according to claim 11, wherein the connector is connected to the circuit board by fixing through any of soldering, welding, and adhering with a conductive paste.

13. The sensor manufacturing method according to claim 11, wherein the cable includes a plurality of strands and an outer covering bundling the plurality of strands, wherein each of the strands includes a core wire composed of a plurality of conductive wires and an inner covering the core wire, wherein the connector further includes a pressure-contact blade provided in each of the first pair of protrusions, wherein the sensor manufacturing method may further comprise, after the third step, a fourth step of tightening the connector so that an interval of the first pair of protrusions becomes narrow, and wherein in the fourth step, the pressure-contact blade penetrates the inner covering to be conductive to the core wire.

* * * * *